US005102110A

United States Patent [19]

Reynolds

[11] Patent Number: 5,102,110

[45] Date of Patent: Apr. 7, 1992

[54] TEMPORAL SYNCHRONIZER FOR APPLICATION OF PRINTING TO A MOVING SUBSTRATE

[75] Inventor: Bruce A. Reynolds, Sussex, Wis.

[73] Assignee: Quad/Tech, Inc., Pewaukee, Wis.

[21] Appl. No.: 404,863

[22] Filed: Sep. 8, 1989

[51] Int. Cl.[5] ..... B41F 13/54

[52] U.S. Cl. ..... 270/1.1; 270/54

[58] Field of Search ..... 400/708, 709, 711; 270/1.1, 52, 54, 58; 101/486, 487; 346/158, 159, 76 L, 108, 160; 219/121.6, 121.61, 121.62; 430/357, 363; 250/347, 341, 340, 338.3, 492.1, 492.3, 316.1, 334

[56] References Cited

U.S. PATENT DOCUMENTS

| | | | |
|---|---|---|---|
| 3,410,203 | 11/1968 | Fischbeck | 346/76 L |
| 3,803,628 | 4/1974 | Van Brimer | 346/1 |
| 3,819,173 | 6/1974 | Anderson et al. | 270/54 |
| 3,848,087 | 11/1974 | Carrell | 346/108 X |
| 3,911,818 | 10/1975 | MacIlvane | 101/426 |
| 4,002,829 | 1/1977 | Hutchison | 346/76 L X |
| 4,121,818 | 10/1978 | Riley et al. | 270/54 |
| 4,306,242 | 12/1981 | Jeffrey | 346/108 X |
| 4,316,073 | 2/1982 | Lemelson | 346/76 L X |
| 4,395,031 | 7/1983 | Gruber et al. | 270/54 |
| 4,596,993 | 6/1986 | Erlichman | 346/76 L X |
| 4,613,877 | 9/1986 | Spencer et al. | 346/108 X |
| 4,675,498 | 6/1987 | Lemelson | 219/121.62 |
| 4,780,006 | 10/1988 | Hamano et al. | 101/93.04 X |

*Primary Examiner*—Edward K. Look
*Assistant Examiner*—Todd Mattingly
*Attorney, Agent, or Firm*—Foley & Lardner

[57] ABSTRACT

An imprinting system of the type including: a conveyer; a plurality of feeders for delivering signatures to a conveyer, the conveyer moving the signatures in a predetermined direction along a conveyer path; a printer disposed proximate to the conveyer along the path for imprinting on portions of signatures within a predetermined print field; improved in that the system further comprises: a scanner for scanning a field of view disposed along the path extending in the predetermined direction in predetermined relation to the print field and generating scanner output signals indicative of the position of the signature within the field of view; and the system for controlling the printer includes varying the position of the print field relative to the field of view in accordance with the movement of the signatures through the field of view.

43 Claims, 14 Drawing Sheets

TEMPORAL SYNCHRONIZER FOR APPLICATION OF PRINTING TO A MOVING SUBSTRATE

DESCRIPTION

1. Field of the Invention

The present invention relates to systems for printing on a moving substrate, and particularly to systems for in-line printing on component signatures of a magazine moving on a conveyor.

2. Background of the Invention

A magazine or the like is conventionally formed by collation of a group of component signatures (sometimes referred to as forms). Each signature typically includes one or more folded sheets which in turn bear four pages of printed material (one page on each side of the respective flaps of the folded sheets). A supply of each signature is placed in an associated signature feeder (sometimes referred to as a "pocket"), disposed in cooperative relationship with a conveyor. As a station on the conveyor passes each feeder in sequence, the feeders are selectively activated to deposit the associated signature on the conveyor. A computer selectively actuates signature feeder pockets to progressively build an individualized group of signatures for each subscriber. In some systems, as part of the collating process, the computer additionally provides coordinated printing information and control signals to, for example, one or more of: off line printers and card inserters to selectively print and insert cards into the magazine; in-line printers to customize or otherwise imprint specific information on the signatures for individual subscribers; and labeling mechanism to print and apply address labels, or directly print addresses on the magazine (using an in-line printer).

One type of such collating system is the conventional demographic saddle stitch bindery line. The typical saddle stitch binding line employs a chain conveyor including a plurality of stations defined by projecting lugs. The signature is typically deposited on a chain conveyor with the flaps hanging on either side of the chain, overlaying any signatures previously deposited on the chain at that station. As the conveyor travels forward, the lugs engage the rear edge of the signature to push the signatures along the direction of conveyance. Thus, respective overlying signatures at the conveyor station tend to be aligned with one edge against the lugs and to travel with the conveyor chain. The signatures are conveyed past one or more printing stations, typically including dot matrix ink-jet print heads mounted in predetermined relation to a printer table or platform to provide support for the signature. In some instances a mechanism to dispose a particular signature for imprinting is also provided.

Examples of demographic bindery systems are described in U.S. Pat. No. 3,819,173 issued to Anderson et al., on June 25, 1974, U.S. Pat. No. 4,121,818 issued to Riley et al., on Oct. 24, 1978 and U.S. Pat. No. 4,395,031 issued to Gruber et al., on July 26, 1983. Ink-jet printers suitable for such systems are described in U.S. Pat. No. 3,803,628 issued to Van Brimer et al., on Apr. 9, 1974 and U.S. Pat. No. 3,911,818 issued to MacIlvaine on Oct. 14, 1975.

The dot matrix print heads used in binding systems imprint a portion of the substrate in predetermined relationship (e.g., adjacent, under) to the head, hereinafter referred to as the print field, comprising a nominal matrix of pixels, e.g. dots, which are selectively darkened by application of ink to form characters. Such systems, however, rely on the movement of the substrate, e.g., the signatures, on the conveyor to provide one element (dimension) of the print field matrix. At any given time, the print head typically imprints a line of successive nominal pixels disposed transverse to the direction of conveyance, selectively depositing drops of ink in the respective pixels to form dots along the traverse line. Separate ink-jets may be provided for each pixel along the line, or the ink droplets may be electrostatically deflected to scan across the transverse line of pixels. As the signature advances, successive lines of dots in effect, define a print field comprising a matrix of pixels in which dots are selectively placed to form printed characters. The operation of the ink-jet, or jets, is therefore synchronized with the motion of the conveyor chain, typically through a tachometer or encoder coupled to the conveyor chain or conveyor drive.

Such systems are disadvantageous in a number of respects For example, the synchronization of the dot matrix printer presupposes that the signatures are disposed against the lugs; it is assumed that signature motion and motion of the conveyor are equivalent. However, in many instances this is not the case. The conveyor chain will occasionally travel in the reverse direction, for example, during the course of unjamming a feeder, or the like. Rearward travel of the chain tends to cause the signatures already deposited on the chain to be disengaged from the lugs; the chain moves in a rearward direction relative to the signatures Likewise, the signatures are sometimes jogged or otherwise displaced from the lugs during travel. Subsequent forward travel of the conveyor will tend to cause displaced signatures to resume a position against the lugs; i.e., relative motion between the signature and conveyor occurs. Where the signature is moving relative to the conveyor during the printing, considerable smearing of the printing can be manifested. In addition, even when seated against the lugs, the motion of the signature imparted by the chain is not necessarily uniform. Mechanical linkages can manifest varying amounts of play not reflected by the tachometer or encoder. Sudden variations in chain motion due to slack in mechanical linkages or the like can similarly sometimes cause smearing of the imprinted matter. Deviations in the lug spacing are not reflected by the signal from the tachometer or encoder, and tend to cause offset from the desired relative disposition of the imprinted material on the signatures. Displacement of the signature from the lugs, when passing the printing station, can similarly cause such effects.

Accordingly, it is desirable that the printing mechanism be synchronized to the actual position of the substrate (e.g., signature), rather than the transport, e.g., conveyor.

It would also be desirable for a printer to operate essentially independently of substrate motion, without interrupting substrate motion.

SUMMARY OF THE INVENTION

The present invention provides a mechanism for synchronizing printing of a substrate on a conveyor to the actual position of the substrate, and further provides a particularly advantageous mechanism for printing on signatures More particularly, in accordance with one aspect of the invention, a scanner is disposed with a field of view corresponding to a portion of the conveyor path to generate output signals indicative of the positions of the signatures within the field of view. The printer is then controlled in accordance with the sensed position of signatures within the scanner field of view In accordance with another aspect of the present invention, the effective position of the operative print field of the printer is varied relative to the scanner field of view in accordance with movement of signatures through the scanner field of view.

The present invention, in another aspect, provides a particularly advantageous printer A laser beam is controllably directed to a desired position on a substrate to effect a controlled burn of the substrate at that position. Reflections of the laser beam from the substrate are monitored to control the extent to which the substrate is burned. For example, when the reflection levels change by a predetermined amount from the initial level, the burning operation is ceased.

BRIEF DESCRIPTION OF THE DRAWING

A preferred exemplary embodiment of the present invention will hereinafter be described in conjunction with the appended drawings, wherein like designations denote like elements and.

DETAILED DESCRIPTION OF A PREFERRED EXEMPLARY EMBODIMENT

Figure 1:
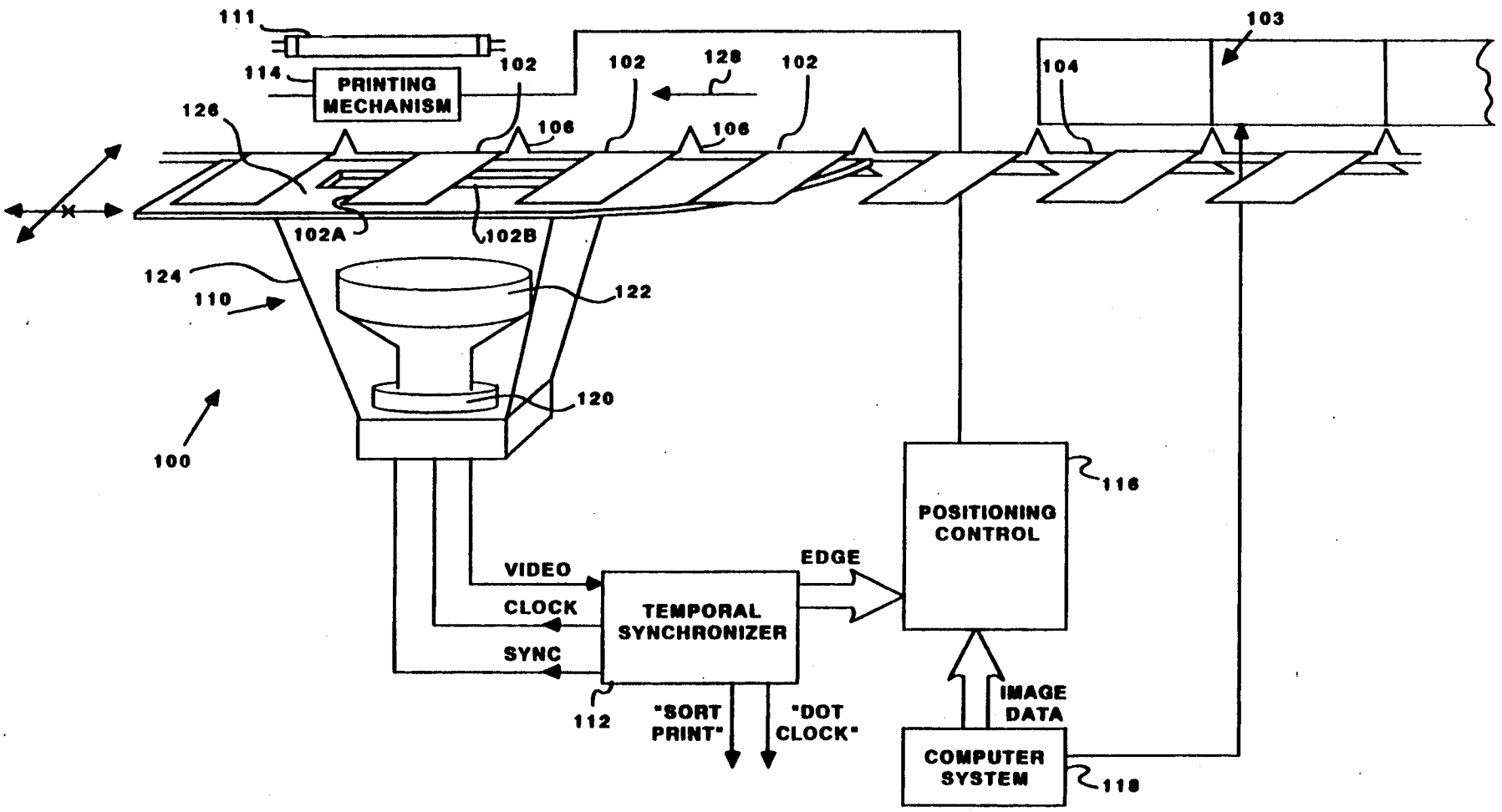
FIG. 1 is a block schematic of a printing system in accordance with the present invention.

Referring now to FIG. 1, an imprinting system 100 in accordance with the present invention, operates to selectively print information on a substrate 102, such as a component signature or group of component signatures of a magazine or book, suitably as part of a collating process. Signatures 102 are suitably provided from respective selectively actuated feeders 103, and transported relative to imprinting system 100 on a conventional conveyor 104, such as a chain conveyor including respective lugs 106, as in a conventional saddle stitch bindery, or a belt conveyor such as typically employed in a perfect bindery.

Imprinting system 100 suitably comprises a line scanner unit 110 cooperating with a suitable stabilized light source 111, a temporal synchronizer 112, a suitable printing mechanism 114, a suitable positioning control 116, and a source of image data indicative of the material to be imprinted on the substrate, e.g., a computer system 118 such as conventionally employed in a demographic bindery line.

Line scanner 110 cooperates with stabilized light source 111 to provide indicia of the relative position of the edges of substrate 102 within a fixed field of view disposed in predetermined relation to printing mechanism 114. Line scanner 110 suitably comprises a conventional linear CCD array 120 such as, for example, a Fairchild-Western Schlumberger CAM/CCD 1500R, cooperating with a suitable lens system 122, and housing 124.

Array 120 and lens system 122 are suitably mounted within housing 124, which is in turn mounted proximate to conveyor 104, in predetermined relation to printer 114 and light source 111. Housing 124 includes a window 126, suitably a linear slot extending along the direction of conveyor travel (as indicated by arrow 128). Window 126 (and the effective field of view of CCD array 120), suitably extends a predetermined distance along direction of conveyance 128, and is preferably of a length greater than that of the print field, and, indeed, the station on conveyor 104, such that window 126 is capable of accomodating a plurality of signatures 102. Stabilized light source 111 and line scanner 110 are disposed in the proximity of conveyor 104 such that: light from light source 111 tends to be received through window 126 and impinge upon CCD array 120; and substrates 102 are transported by conveyor 104 past housing 124, traversing window 126, interposed between light source 111 and window 126. In this regard housing 124 may incorporate the equivalent of a conventional printing table or plow over which signatures 102 are driven or a separate slotted or apertured printing table or plow cooperating with housing 126 can be employed.

Printing mechanism 114 is disposed proximate to the conveyor 104 in predetermined relation to (at a predetermined position relative to) the field of view of scanner 110. Preferably substrate 102 is imprinted while within the field of view of line scanner 110. Printing mechanism 114 may, for example, be mounted overlying scanner 110, to the side of light source 111, or adjacent scanner 110 underlying an apertured print table, accessing substrate 102 through the table aperture. If desired, multiple printing mechanisms may be employed, at various dispositions.

As previously noted, scanner 110 provides indicia of the position of the edges of substrate 102 relative to (e.g., within) the scanner field of view, and this relative to printer 114. The field of view of scanner 110 is, in effect, comprised of a predetermined number (e.g., 2048) of nominal elements (pixels), each representing a fraction (e.g., 1/2048) of the field of view. As a substrate 102, transported by conveyor 104, traverses window 126, it progressively blocks the light to successive pixels of array 120. Array 120 thus provides a video signal in which the position of the leading edge 102A, and ultimately the trailing edge 102B, of signatures traversing window 126 are manifested by light to dark and dark to light transitions. More specifically, an initial synchronization signal (sync) (from temporal synchronizer 112) causes, in a conventional manner, the transfer of charge from the CCD sensors into a CCD substrate latch In response to each subsequent CLOCK signal (from temporal synchronizer 112), the values in the latches corresponding to the successive CCD elements (pixels) are output in succession as an analog video output signal for application to temporal synchronizer 112.

Temporal synchronizer 112 provides synchronization (sync) and CLOCK signals to scanner 110, and develops indicia of the location (pixel address) and nature (polarity) of substrate edges within the field of view of scanner 124. Temporal synchronizer 112 will hereinafter be more fully described in conjunction with FIGS. 2, 3A, 3B and 3C. The edge data from temporal synchronizer 112, indicative of the position of the substrate within the scanner field of view is provided to positioning control system 116.

Positioning control 116 generates the appropriate servo signals to adjust the effective positioning or alignment of printer mechanism 114 relative to scanner 110 (and this relative to signature 102), and provides the image data to be imprinted to printing mechanism 114 in synchronism with the scan. As will be explained, position control 116, in effect, causes the position of the print field of printing mechanism 114 to be adjusted relative to the portion of the conveyor path corresponding to scanner field of view to compensate for movement of substrate 102 during the imprinting process. Positioning control 116 will be more fully described in conjunction with FIGS. 4–12.

Printing mechanism 114 may be any mechanism for selectively marking portions of signatures 102 within a nominal print field However, to achieve full advantage of various aspects of the present invention, it is desirable that printing mechanism 114 be of a type capable of, in effect, adjusting the disposition of the print field relative to the portion of the conveyor path in response to signals indicative of the position of signature 102 within the scanner field of view. By adjusting the disposition of the print field in accordance with substrate motion, printing errors related to substrate motion can be substantially eliminated. A suitable printer may, for example, physically, or in the case of "beam" systems, electrically or optically, shift the print field relative to the conveyor path. Alternatively, a printer may selectively mark individual pixels in nominal matrix which is of a considerably greater extent than the operative print field (corresponding to the area on signature 102 to be imprinted). The operative print field is then, in effect, shifted within the overall matrix in accordance with signature movement to adjust the disposition of the print field relative to the scanner field of view.

Where a conventional ink jet head is employed as printing mechanism 114, the system will not be independent of substrate motion. However, substantial advantage will still be realized by employing scanner 110 and temporal synchronizer 112 to provide a print start and dot (line) clock signal conventionally provided by a proximity detector and tachometer or encoder; the system is rendered insensitive to offset of the signature on the conveyor.

In accordance with one aspect of the present invention, printing mechanism 114 comprises a scanning laser printer Use of a laser printer is particularly advantageous in that the speed at which the laser beam is scanned across the print field is significantly greater than the transport speed of signature 102 on conveyor 104. The laser beam effects a scan of the print field, to selectively darken (burn) the signature in respective pixels to form the imprinted characters. The position of the scan rows (scans in the direction transverse to direction of conveyor 128) relative to the scanner field of view, and hence printing mechanism 114, is adjusted to account for movement of signature 102 This effectively makes the printing process independent of transport motion of the substrate. Further, by relating the printing operation to the position of the edge of the substrate, rather than merely synchronizing the printing mechanism with conveyor motion, the system is rendered substantially insensitive to offsets of the substrate from the assumed position on the conveyor.

Figure 2:
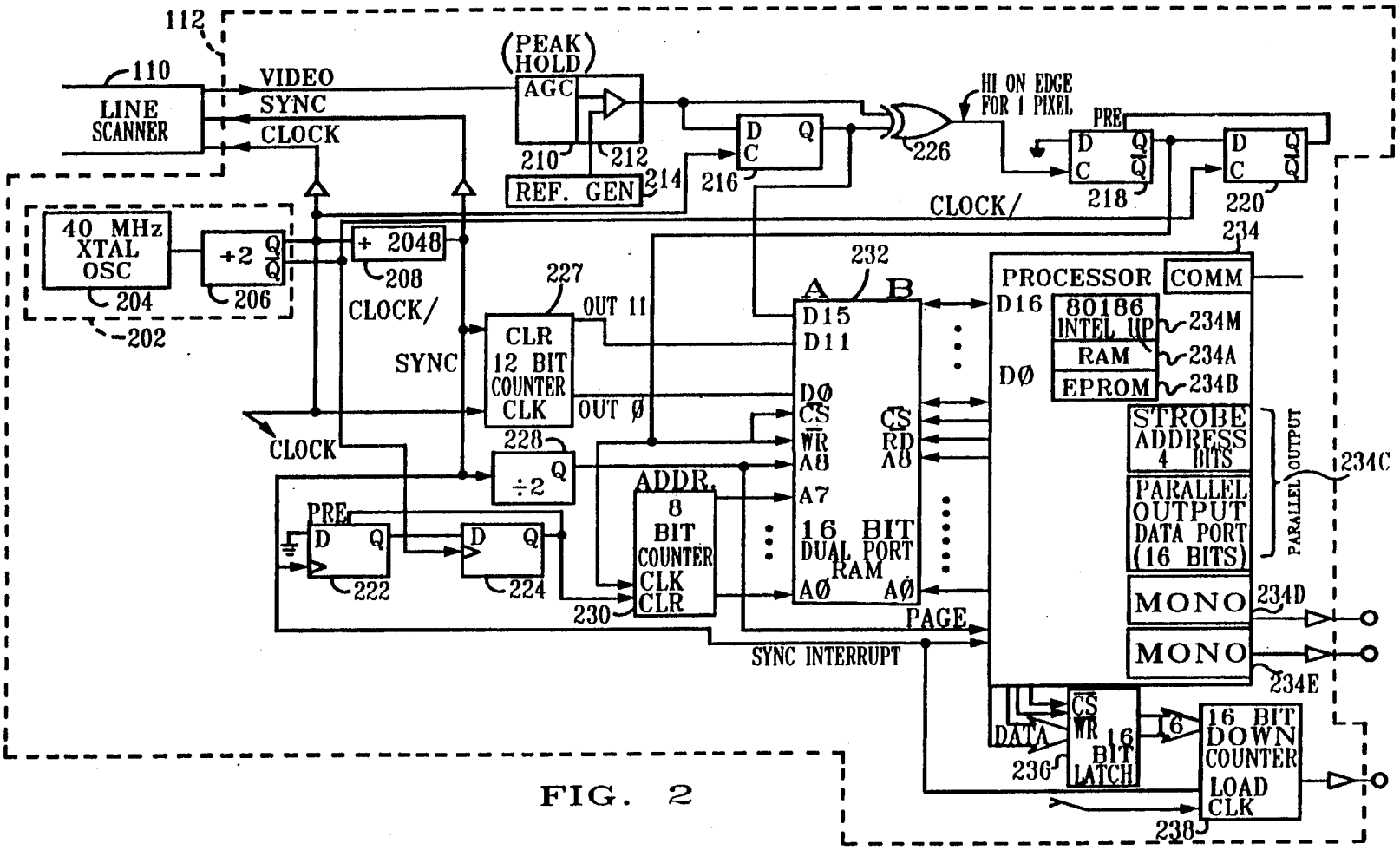
FIG. 2 is a block schematic of a preferred embodiment of a temporal synchronizer in accordance with the present invention.

Referring now to FIG. 2, temporal synchronizer 112 suitably comprises a conventional clock generator 202, suitably comprising a 40 MHz crystal oscillator 204 and divider (divide by 2) 206; a divider 208 having a number of stages indicative of the number of pixels in CCD array 120 (divide by 2048); a suitable conventional peak hold automatic gain control circuit 210; a high speed comparator 212, cooperating with a suitable reference signal generator 214; respective flip-flops FF's 216, 218, 220, 222 and 224; an exclusive OR gate (XOR) 226; a divider 228 (divide by 2); an eight-bit address generator (counter) 230 having a high going edge sensitive clock input; a conventional 8-bit dual port random access memory (RAM) 232; and a processor 234. Processor 234 suitably comprises a conventional microprocessor 234M, e.g., an Intel 80186, cooperating with a RAM 234A and EPROM 234B, and a several parallel output data ports 234C. In some instances, such as for example, where temporal synchronizer 112 is intended to provide control signals to a conventional ink jet printer head respective programmable monostable output ports 234D and 234E; a 16 bit latch 236; and a 16 bit down counter 238 may also be provided Programmable monostables 234D and 234E provide for selective generation of a software triggered sync pulses for external devices, such as a print start and dot line clock to a conventional ink jet printer. Latch 236 and counter 238 can be utilized to provide a pulse having an edge synchronized with substrate position.

Synchronizer 112 generates the necessary signals to effect synchronization between line scanner 110 and the storage of transition information in RAM 232. Clock generator 202 generates a clock signal (CLOCK) of a predetermined frequency (20 MHz), and an opposite phase clock signal (CLOCK/), 180 degrees out of phase. The CLOCK signal is applied through a suitable buffer as the clock signal to line scanner 110, and is also applied to a 12 bit counter 227, to develop a count indicative of the particular pixel of the line scan field of view instantaneously represented in the video output signal.

The CLOCK signal is also applied to divider 208, which generates a "sync" signal at the end of the number of CLOCK cycles corresponding to the number of pixels in the line scan (e.g., 2048). The sync signal is applied through a suitable buffer to line scanner 110 to initiate the scan, as previously described. The sync signal is also applied: to the clear input of counter 227 to synchronize the pixel count with the line scan; as a clock to divider 228 to FF 222 to faciliate use of plural banks of memory locations in RAM 232; as an interrupt signal to processor 234 signifying the availability of transition data; and as a load command to programmable down counter 238.

Indicia of relative position edges in the line scanner field of view for each scan is developed in RAM 232. The video signal from line scanner 110 is analyzed to detect and determine the relative location of brightness transitions (light to dark or dark to light) in the scan. The video signal is applied to automatic gain control circuit 210. AGC circuit 210 samples and holds peak values and amplifies the signal accordingly. The gain controlled signal is applied to comparator 212 which compares (with suitable hysteresis) the signal to a predetermined reference level indicative of a predetermined brightness level to provide an output indicative of the presence or absence of an intervening object over the instantaneous pixel of the line scan. The reference level signal is provided by reference generator 214. Reference generator 214 can comprise any suitable mechanism; for example, a voltage divider circuit can provide a predetermined constant value, or a potentiometer can be included to provide for manual adjustment. Alternatively, reference generator 214 can comprise an analog to digital converter cooperating with a latch addressable by processor 234 to provide for adaptive control of the threshold level.

Transitions in the scan are detected by comparing the state of the successive pixels. To this end, a preceeding pixel value is latched in FF 216. Specifically, FF 216 is clocked by the leading edge of the CLOCK signal. At the point, AGC circuit 210 and comparator 212 presents the value of the preceeding pixel to the D input of FF 216, which latches, and presents that value at the Q output of FF216. XOR 226 is therefore temporarily driven low. However, the CLOCK pulse also causes AGC circuit 210 to output the next successive pixel to comparator 212. Comparator 212 thus generates, a successive pixel value a finite time after the leading edge of the CLOCK pulse (but before the next clock). The successive pixel value output of comparator 212 applies to the D input of FF216 and, together with the latched value in FF216, to the input of XOR 226. The comparator output is not latched into FF216 until the next clock pulse. Accordingly, XOR 226 effects a comparison of successive pixel values. If the successive pixel values are different, the output of XOR gate 227 goes high.

When a transition is detected, as reflected by a high logic level output signal from XOR gate 226, FF's 218 and 220 generate a one cycle active low write pulse to dual port RAM 232 to effect storage of the pixel count corresponding to the location of the transition, and the polarity of the transition are stored in the location of dual port RAM identified by the contents of address generator 230. The write pulse is provided from the Q output of FF 218, initiated in response to the positive going output of XOR gate 226, and terminated upon the next successive opposite phase CLOCK (CLOCK/) pulse. More specifically, the Q output of FF 218 is applied to the data input of FF 220, which is clocked by opposite phase clock signal CLOCK/. The Q output of FF 220 is fed back to the preset (PRE) input of FF 218. Thus, after the positive going output of XOR 226 causes the Q output of FF 218 to go low, the leading edge next successive opposite phase clock signal (CLOCK/) will cause FF 220 to assume the low level provided from FF 218. The transition in the Q output of FF 220 is provided at the preset input of FF 218. The Q output of FF 218 therefore goes high, terminating the write pulse. The positive going transition in the write pulse then causes address generator 230 to increment in preparation for storage of the next successive transition. Thus, an array of edge position/polarity data is generated in consecutive locations of dual port RAM 232.

Address counter 230 is cleared at the end of each scan. More specifically, to ensure that any write cycle in process at the end of the scan is completed, a clear signal to address generator 230 is generated one clock pulse after the generation of a sync signal. Specifically, the sync signal is applied as a clock signal to FF 222, which, since the D input of FF 222 is tied low, causes the Q output thereof to go low. The Q output of FF 222 is applied to the D input of FF 224. Upon the next successive opposite phase clock pulse CLOCK/, the low logic level is assumed by the Q output of FF 224, causing counter 230 to be cleared, and presetting FF 222. Upon the next successive opposite phase clock, FF 224 thus resumes an initial high level.

To facilitate real time operation, the transition array for one scan cycle is read out of RAM 232 while the array for the next successive scan cycle is generated. Accordingly, two banks (pages) of memory locations are employed. The eight least significant bits of the address of the location into which the transition data is loaded is provided by counter 230. The most significant bit of the address, operating as a page (bank) select, is provided by divider 228. The output of divider 228 toggles in response to each sync pulse, thus alternately designating the respective banks of memory.

As previously noted, sync signal is applied as an interrupt to processor 234. In response to the interrupt, microprocessor 234M accesses the transition data through the B port of RAM 232 and provides a pixel start address for the substrate, e.g., the address of the leading edge of the signature, on the parallel port for communication to positioning control 116. If desired, processor 234 may also perform a discrimination process to ensure that the transitions correspond to substrate edges. For example, the distance between opposite going transitions can be determined and compared to the known length of the substrate. In addition, statistical data on the operation of the system can be generated.

Figure 3A:
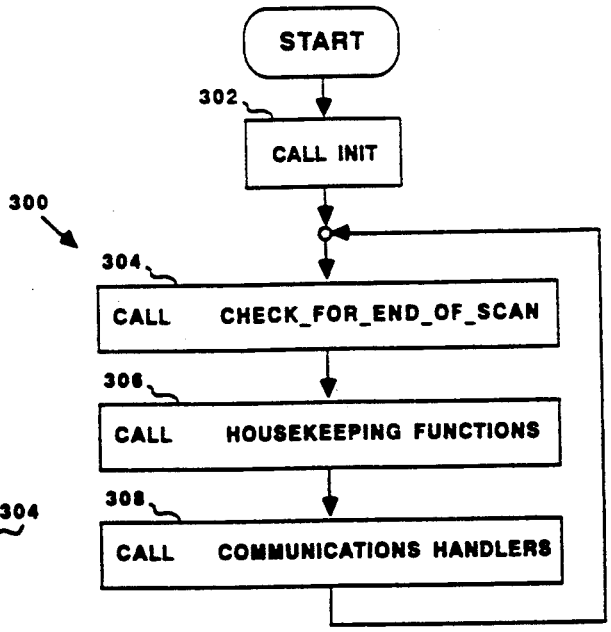
FIG. 3A is a schematic flow chart of the main loop effected by microprocessor FIG. 2.

Processor 234 provides indicia of the position of the relevant substrate edge to positioning control circuitry 116. In general, microprocessor 234 operates in accordance with a program of instructions maintained in EPROM 234B. Referring to FIG. 3A, upon power-up, microprocessor 234M performs a conventional processor initialization routine (step 302). For example, status checks and diagnostic routines are effected as well known in the art, and, where serial pulse outputs are desired, monostables 234D and 234E are loaded with indicia of desired pulse widths, and, discriminant, (e.g., min and max length) print field boundary, e.g., start print, and line spacing values established in RAM 234A.

After initialization is completed, a main loop 300 is entered. A check for end of scan routine 304 is executed to determine whether data representing a full scan of line scanner 110 is present in dual port RAM 232, and if so, to extract a position data and provide appropriate output signals. A check for end of scan routine 300 will be more fully described in conjunction with FIGS. 3B and 3C.

After a return has been effected from routine 304, various conventional housekeeping function routines (step 306) and communication handling routines (step 308) are executed. For example, housekeeping functions such as a partial check sums on system memory, and communications with positioning unit 116, and other external devices may be effected, as well known in the art. Loop 300 is then repeated.

Figure 3B:
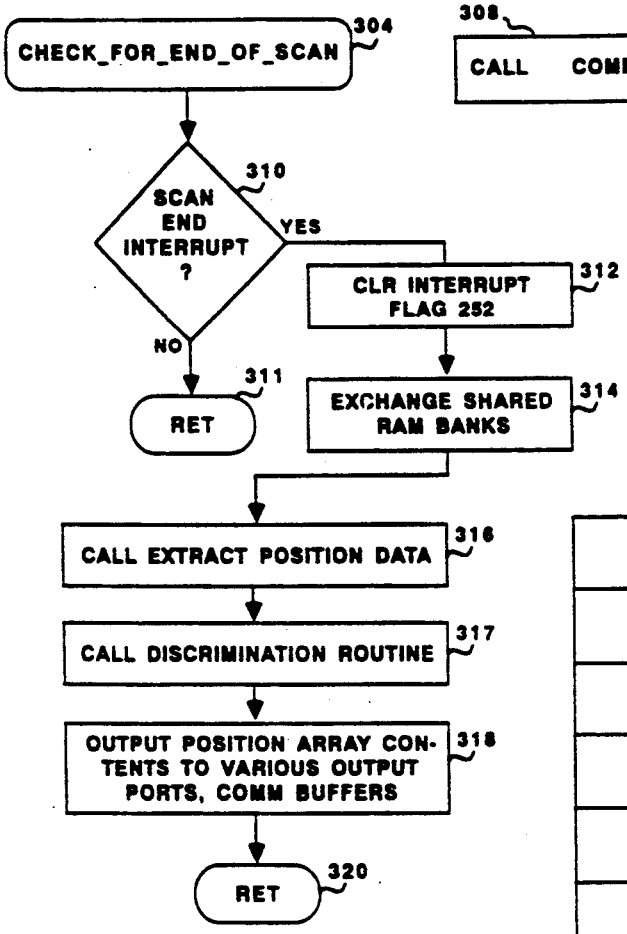
FIG. 3B is a schematic flow chart of the check for end of scan routine of FIG. 3A.
Figure 3C:
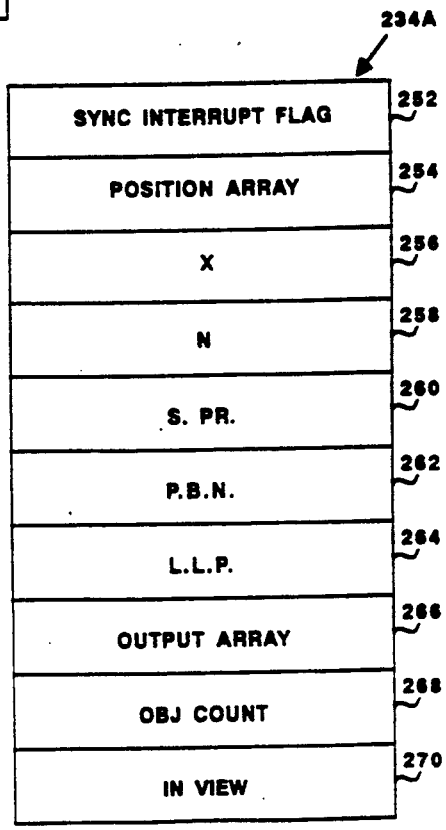
FIG. 3C is a schematic illustration of various variables and flags maintained in random access memory associated with the microprocessor of the temporal synchronizer of FIG. 2.

Referring now to FIGS. 3B and 3C, check for end of scan routine 304 will be more fully described. As previously noted, the sync signal generated by divider 208 is applied to microprocessor 234M as an interrupt. A sync interrupt flag 252 (FIG. 3C) in RAM 234A is set in response to sync interrupt signal. Upon initiation of check for end of scan routine 304, flag 252 is checked to determine whether a scan and interrupt has occurred (step 310). If not, a return to main loop 300 is effected (step 311). Assuming that a sync interrupt has been received, however, interrupt flag 252 is cleared (step 312). The alternative bank (page) of memory in RAM 232 is addressed (step 314), and an extract position data routine 316 is executed. Routine 316, to be more fully explained in conjunction with FIG. 3D, creates a position array 254 in RAM 234A, containing a record for each transition pair (bright to dark, followed by dark to bright).

If desired, a suitable discrimination routine can be executed (step 317) to eliminate those transition pairs which do not meet predetermined criteria associated with substrate 102, from array 254, or create a separate output array 266 (FIG. 3C) of the starting addresses of substrates meeting the predetermined criteria. For example, the length values in array 254 can be compared against maximum and minimum values to discriminate spurious objects. Likewise, the start and end addresses in the records can be compared against predetermined discriminant values, e.g., zero, to insure the substrate is entirely within the scanner field of view and/or the boundary addresses of the operative print field to determine if the substrate is partially, or entirely, within the operative print field. The start addresses from records meeting the predetermined criteria are suitably entered in sequence in output array 266. Further, during the discrimination routine (or, if discrimination is omitted, during step 316), a count OBJCOUNT (location 268, FIG. 3C), indicative of the number of substrates meeting the criteria is developed. (Alternatively, all or part of the discrimination can be effected in positioning control 116.)

Outputs corresponding to the contents of position array 254 are then selectively applied to the various output ports and devices (step 318). For example, the address of the edge of signature 102 is provided at parallel output ports 234C, (together with an appropriate device, e.g., printer address code) Ports 234C provide a start address to positioning control 116 (FIG. 4). Further, serial output pulses can be generated by selectively triggering programmable monostables 234D and 234E. The generation of serial pulses can be implemented as a subroutine (318A) as will be more fully described in conjunction with FIG. 3E. In general however, programmable monostable 234D is triggered (e.g., by a conventional write operation by microprocessor 234M, in a manner well known in the art), to generate a pulse when the edge of substrate 102 is detected at a predetermined position within the scanner field of view. Such a pulse can be utilized, for example, as a "start print" signal to a conventional ink-jet printer (typically generated by a proximity detector or encoder). Monostable 234E is triggered, likewise by a conventional write operation to generate respective "incremental" pulses in response to unit advancements of the edge of substrate 102 through the scanner field of view. The incremented pulse can be utilized as the "dot" clock to a conventional ink jet printer. A return to main loop 300 is then effected (step 320).

Figure 3D:
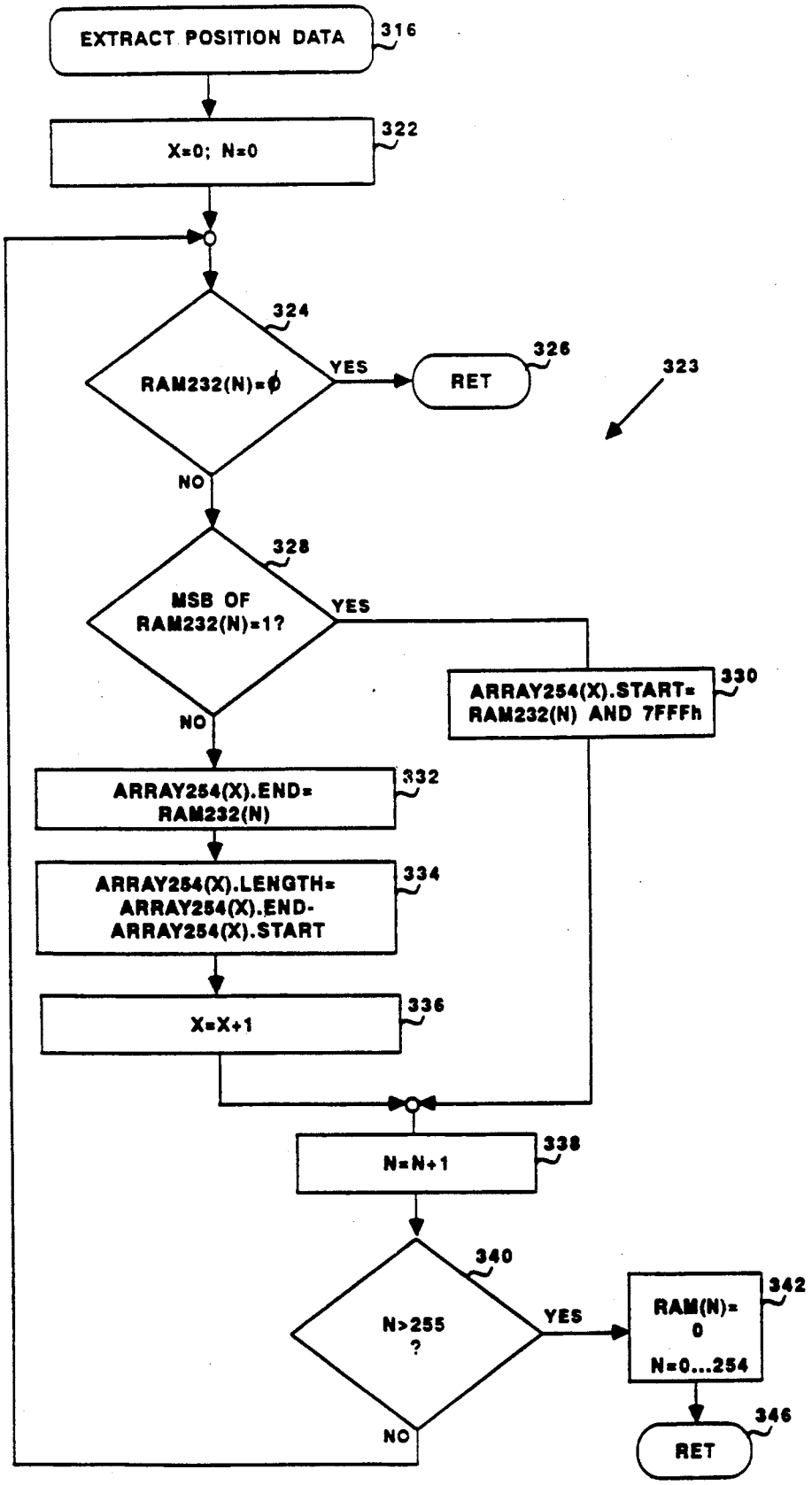
FIG. 3D is a schematic flow chart of the extract position data routine of FIG. 3B.

Referring now to Figure 3D, extract position data routine 316 will be described. As will be recalled, the selected bank (page) in RAM 232 contains, in successive locations, transition data corresponding to each successive brightness transition encountered in the line scan, i.e., a polarity value followed by the address (pixel count) of the transition. Routine 316 generates position array 254 in RAM 234A from the transition data in RAM 232. Position array 254 includes a record for each transition pair, comprising, in successive bytes, a start address field, an end address field, and a length field. Upon initiation of routine 316, respective pointers "X" 256 to RAM 232, and "N" 258 to records in position array 254 (FIG. 3C) are initially set to zero (0) (step 322), and an array generation loop 323 entered.

Upon entry to loop 323, the contents of the designated location in RAM 232 (initially relative location zero), are tested for a non-zero value (step 324). If the contents of the location in RAM 232 are zero, then no further edge data is present in the RAM, and a return is effected to check for end of scan routine 304 (step 326).

Assuming that the content of the designated location (relative address N) in RAM 232 is non-zero, the polarity of the associated transition, as indicated by the most significant bit of RAM (N), is determined (step 328). If the transition is positive going (light to dark, MSB=1) indicating a leading edge, the most significant bit is, in effect, stripped off (by ANDing 7FFF hexadecimal) and the remainder contents of RAM (N) and loaded into the start field of the designated record (record X) in position array 254 (step 330).

Assuming, however, that the most significant bit of the designated location in RAM 232 equals zero, a negative going transition (dark to light; MSB=0) is indicated, corresponding to a trailing edge. Accordingly, the contents of relative location N of RAM 232 are loaded into the field of record X of position array 254 (step 332). The length (end address minus start address) is then calculated and loaded into the length field of record X of position array 254 (step 334). The record pointer X is then incremented (step 336).

This process is repeated for each transition entry in RAM 232 in sequence. After the start field of array X has been loaded, or the end and length fields loaded and X pointer incremented, as appropriate, the pointer N to RAM 232 is incremented (step 338), and a test effected to determine if the bounds of the page (bank) in RAM 232 has been exceeded (step 340). If not, the process is repeated for the next successive transition entry in RAM 232. If the bounds are exceeded (N exceeds 255), the page in RAM 232 is cleared (step 342) and a return effected to check for end of scan routine 304 (step 346).

As previously noted, serial pulses appropriate for controlling a conventional ink-jet printer can be generated by selectively triggering monostables 234D and 234E. In essence, monostable 234D is triggered when the edge of substrate 102 is detected at a predetermined position within the scanner field of view. Monostable 234E, is triggered in response to incremental movement of the edge of substrate 102; the instantaneous edge address is compared to the address of the edge when the last incremental pulse was generated, and monostable 234E triggered when the difference reaches a predetermined value, e.g., corresponding to line spacing. Either or both of monostables 234D and 234E can be employed as desired.

Figure 3E:
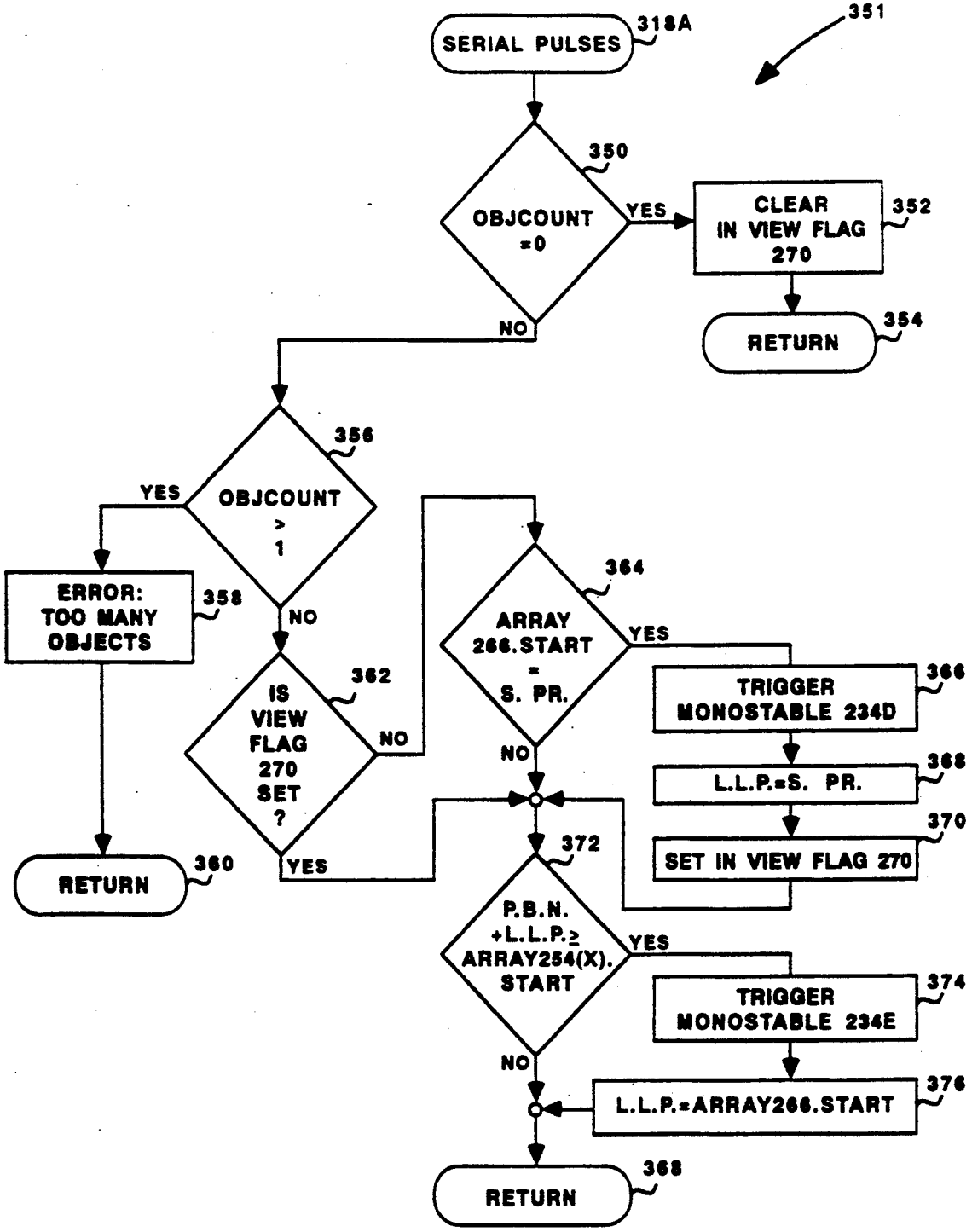
FIG. 3E is a schematic flow chart of an exemplary subroutine for selectively generating serial output pulses.
Figure 4:
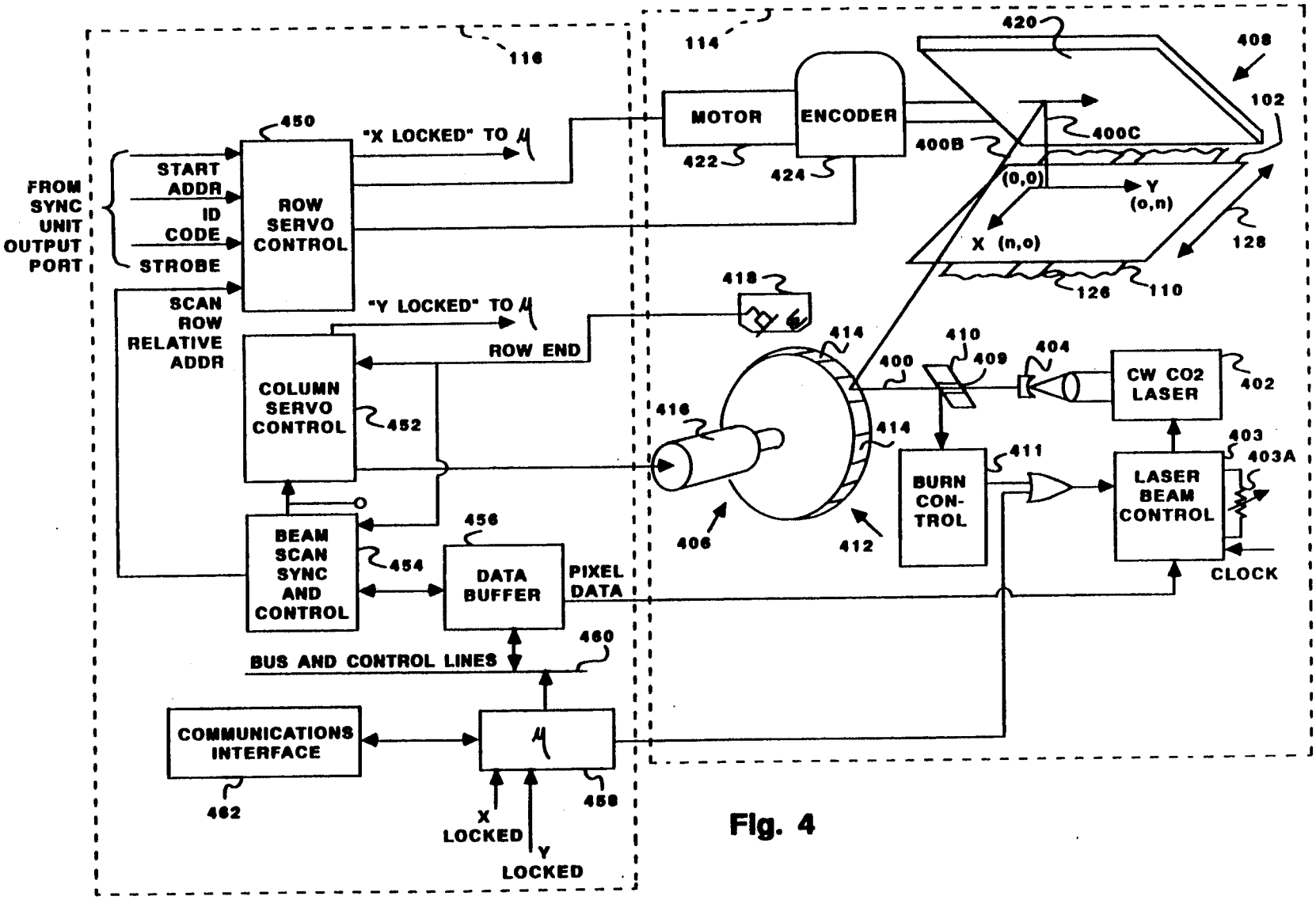
FIG. 4 is a block schematic of a scan control and of a suitable laser printer unit in accordance with another aspect of the present invention.

Referring now to FIG. 3E, a subroutine 318A suitable for generating both start print and incremental pulses (e.g., Dot clock) where only one substrate 102 is within the print field at any given time, will be described. In such a case, print field boundaries are employed as discriminants, and OBJCOUNT 268 should be zero or one. During initialization routine 302, start print (S. PR.) and line spacing (PBN) values are established in locations 260 and 262, respectively, of RAM 234A (FIG. 3C). Upon entry into subroutine 318A, a determination is made as to whether any valid substrate records are contained in array 266, i.e., whether a proper substrate 102 has entered the operative print field (step 350). Specifically, the value of the OBJCOUNT 268 is tested zero to determine that records exist in array 266. If it is determined that no substrate records are contained in array 266, an INVIEW flag 270 is cleared (indicating no substrate is in the print field) (step 352), a return to a check-for-end-of-scan routine 304 is effected (step 354).

Assuming that OBJCOUNT 268 is not equal to zero, a test is effected to insure that only one substrate 102 is within the operative print field i.e., OBJCOUNT 268 is not greater than one (step 356). If OBJCOUNT 268 is greater than one, an error message is generated (step 358) and a return to routine 304 effected (step 360).

Assuming that only one substrate is within the print field, INVIEW flag 270 is tested to determine if a start print pulse has already been generated with respect to a given substrate (step 362). If INVIEW flag 270 has not been set, and OBJCOUNT 268 equals one, a substrate has just entered the print field, and the start print pulse is to be generated. Specifically, the substrate leading edge (start) address compared to the preset start print address (S. PR.) in location 260 (step 364). If the address in the start field of array 266 is equal to the preset start print value: monostable 234D is triggered (step 366), the last incremental (line; dot) pulse address (LLP) is set to the start print value (step 368); and INVIEW flag 270 is set (step 370). In some instances, monostable 234E would also be triggered to provide an incremental pulse contemporaneously with the start print pulse provided by monostable 234D.

After the INVIEW flag 270 has been tested and monostable 234D triggered, LLP variable initialized, and flag 270 set, as appropriate, incremental advancement of substrate 102 is tested against preset value P.B.N. (step 372). More specifically, the contents of the start field of array 266 is tested against the sum of the last incremental pulse address (L.L.P.) in RAM location 264, and the line spacing value (PBN) in location 262. If the sum is greater than or equal to the starting address of the substrate, i.e., the start field in array 266 monostable 234E is triggered (step 364), and the substrate start address loaded into location 264 as a new LLP value (step 376).

After the incremental movement of substrate 102 has been tested and monostable 234E triggered and LLB value established as appropriate, a return to routine 304 is effected (step 378).

Referring now to FIG. 4, print mechanism 114 suitably comprises a conventional continuous wave $CO_2$ laser 402 with a cooperating conventional beam control unit 403, a suitable focusing lens system 404, row (X) and column (Y) deflection mechanisms 406 and 408, and a burn control mechanism 411 cooperating with an apertured mirror 410.

Laser 402 generates a laser beam 400, which is focused (narrowed) by lens system 404 and directed through partial beam splitter 410 to impinge on Y deflection mechanism 406. Y deflection mechanism 406 controllably reflects beam 400 to impinge on X deflection mechanism 408, scanning the beam along a line corresponding to a direction (the nominal Y direction) transverse to the motion of conveyance 128. In the preferred embodiment, the beam is deflected over a transverse range of 8 inches. X deflection mechanism 408 in turn controllably reflects beam 400 to impinge on substrate 102 at a pixel having a desired position in the direction of substrate travel (X direction) and corresponding to the instantaneous Y position of the beam as controlled by Y deflection mechanism 406. As will be explained, deflection mechanisms 406 and 408 are controlled to effect the equivalent of a raster scan of beam 400 on substrate 102. Beam 400 is scanned across all of the pixels in a row (i.e., scanned in the Y direction), then the X position is adjusted to correspond to the next row, and transverse scan is repeated. This process is repeated for each row in succession.

In the preferred embodiment, the scan defines a print field comprising a 2048 by 1024 pixel matrix, with 120 pixels per inch, covering a rectangular area extending 8 inches transverse to the direction of conveyance 128 (in the Y direction) and 16 inches in the direction of conveyance (the X direction).

In the preferred embodiment, laser beam 400 selectively effects a controlled "burn" of designated pixels on substrate 102, causing the pixel area to darken.

As will be explained, the extent to which a designated pixel is burned is controlled by modulating beam 400, (e.g., selectively turning the beam on and off, varying the intensity of the beam, deflecting the beam into a blocking mechanism, effecting interposition of a blocking mechanism into the beam path, or the like).

Laser beam 400 is directed to impinge on a selected pixel with that intensity and for that period of time necessary to darken the pixel by a predetermined amount. It is desirable, however, to ensure that substrate 102 is not burned beyond the extent necessary for darkening. Accordingly, in accordance with one aspect of the present invention, reflections of laser beam 400 from substrate 102 are monitored to determined when the desired darkening has been achieved Specifically, light from laser beam 400 tends to be scattered from substrate 102. A portion of the scattered light (hereinafter referred to as reflected light), travels along the path of impingement. Darker areas tend to absorb energy and reflect less light. Accordingly, apertured mirror 410 is disposed in the path of beam 400. Mirror 410 passes beam 400 through its aperture 409, but directs the non-coherent reflected light to a burn control circuit 411. Burn control circuit 411 generates a signal indicative of changes in the level of reflection, compares the change level of reflection to a predetermined threshhold level, and cause laser beam control 403 to effectively disable beam 400 (e.g., decrease the intensity of beam 400, turn off beam 400, or block beam 400, etc.) when the change in reflection level exceeds the threshhold level. Burn control circuit 111 will be more fully described in conjunction with FIG. 13.

Y deflection mechanism 406 comprises a rotating mirror 412 with a plurality of facets, e.g., a wheel bearing a predetermined number, e.g., 24, of substantially identical individual planar mirrors 414 (facets). Mirror 412 is continuously rotated by a motor 416.

Rotating mirror 412 is disposed in the path of laser beam 400. As mirror 412 rotates, the angle of the mirrored surface on which laser beam 400 impinges changes, varying linearly from a predetermined initial angle corresponding to the beginning cf a Y-scan (Y=o) to a predetermined terminal angle corresponding to the end of the Y-Scan (Y=n). This causes the reflected beam (400B) to scan (move) in the Y direction from the initial position (Y=o) to the end position (Y=n). As the rotation of mirror 412 causes the beam to pass over the juncture between respective adjacent facets 414, the relative angle reverts to an initial angle, causing beam 400 to assume its initial Y position, and the Y scan repeats. As will be explained, rate of rotation of mirror 412 is controlled so that a number of clock pulses corresponding to the number of nominal pixels in a row of the printing field matrix (i.e., the number of columns in the matrix) occur during the traversal of each mirror through beam 400.

Y deflection mechanism 406 also suitably include an optical detector 418 (e.g., comprising a light and photo cell disposed in predetermined relation to rotating mirror 412, (and to beam 400) to detect junctures between mirror facets 414, and generate a "row end" pulse each time a juncture between mirror facets 414 traverses beam 400, i.e., the reflected beam resumes the initial Y position.

X deflection mechanism 408 suitably comprises a planar mirror 420 mounted on the output shaft of a suitable DC servomotor 422. An encoder 424 is provided to generate a signal indicative of the actual angular position of mirror 420.

Mirror 420 is disposed for pivotal motion about an axis parallel to the plane of substrate 102, and is of a length corresponding to the extent of the desired Y-scan. Mirror 420 is disposed to receive reflected laser beam 400B from rotating mirror 412, and reflects the beam (400C) onto a pixel on substrate 102 having a Y position in accordance with the instantaneous angle of the rotating mirror facet relative to laser beam 400, and an X position in accordance with the angle of the surface of mirror 420 relative to reflected beam 400B. In other words, the angular disposition of the front surface of mirror 420 will dictate the X position of the beam, and the instantaneous rotary position of mirror 412 will dictate the Y position of the beam.

As will be explained, the angular position of mirror 420 is initially adjusted, and then re-adjusted after each Y scan, to advance beam 400 through each of the rows of the print matrix in sequence. As will be explained, the disposition of each row is effected in accordance with the contemporary position of substrate 102 within the field of view of line scanner 110, the angular position of mirror 420 is adjusted not only to advance through the successive rows of the matrix, but also to account for the transport of substrate 102 along direction of conveyance 128 (the X direction).

Positioning control 116 provides the appropriate drive signals to deflection mechanisms 406 and 408 to synchronize the scan of beam 400 with the position of substrate 102 and synchronize the application of pixel data to laser beam control 403 (ultimately, laser 402) with the scan of the beam. Positioning control 116 suitably comprises a row servo control circuit 450 for generating drive signals to motor 422 of X deflection mechanism 408; a column servo control circuit 452 for generating drive signals to motor 416 of Y deflection mechanism 406; a beam scan and sync control for generating clock signals and maintaining indicia of the address of the pixel instantaneously impinged upon by beam 400; a data buffer for storing blocks of data corresponding to the image to be imprinted and providing the pixel data to laser beam control 403 in synchronism with the scan; a microprocessor 458, which communicates with data buffer 456 and various other components of the system through a bus 460. Microprocessor 458 cooperates with a conventional communications interface 462 to communicate with, inter alia, computer system 118 (FIG. 1) to receive the image data to be imprinted on substrate 102, and provide blocks of data to buffer 456.

Figure 5:
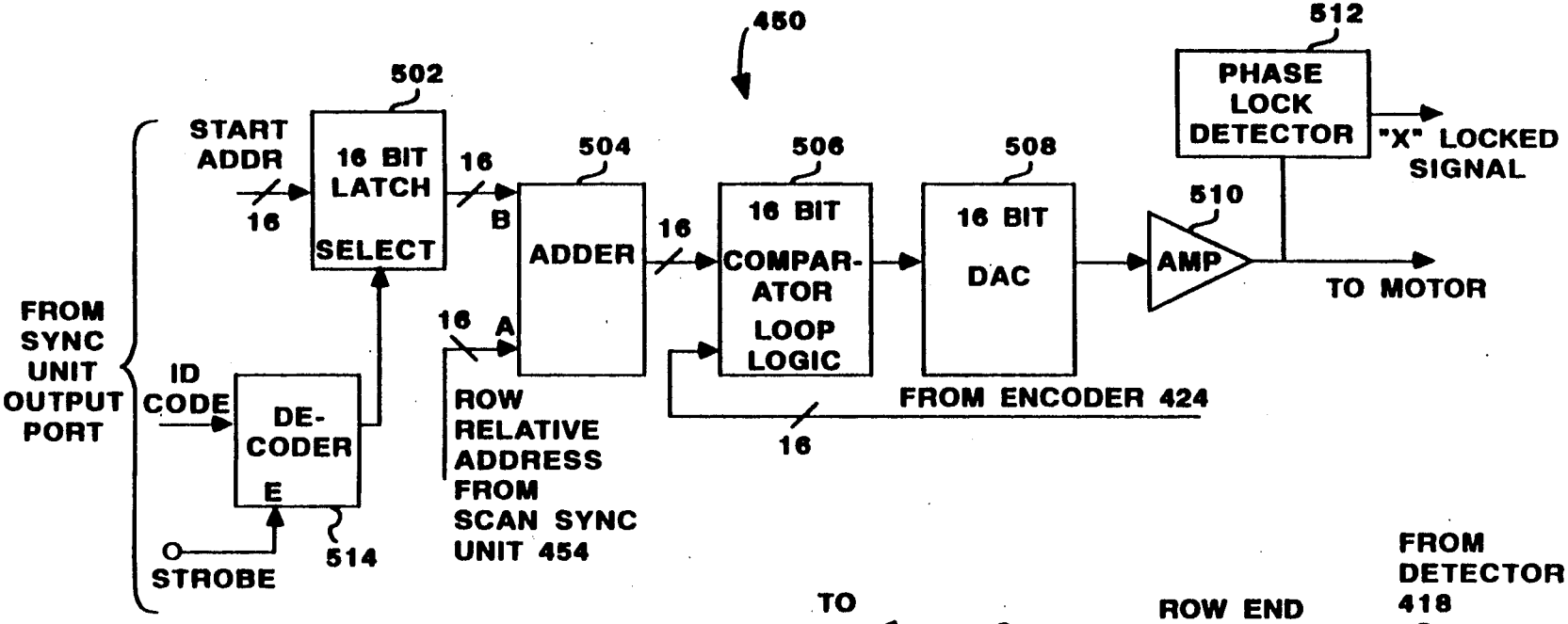
FIG. 5 is a block schematic of a preferred embodiment of the row servo control of FIG. 4.

Row servo control 450 generates the appropriate drive signal to motor 422 of the X deflection mechanism 408, in accordance with address of the leading edge of substrate 102 (relative position within the print matrix, and the actual angular position of mirror 420. Referring to FIG. 5, row servo control 450 suitably comprises a 16 bit latch 502; an adder 504, a 16 bit comparator 506, a 16 bit digital to analog converter (DAC) 508, an amplifier 510, and a phase lock detector 512. A start address, indicative of the actual position of substrate 102 within the field of view of scanner 110 is applied to latch 502. Where temporal synchronizer 112 provides a plurality of signals to different devices, latch 502 may be actuated by a suitable decoder 512 receptive of an identification code and strobe signal provided from the parallel output port of sync unit 112. The start address is algebraicly summed with the relative address within the matrix of the particular row to be scanned by beam 400. The output of adder 504 is thus indicative of the position of the row relative to the edge of substrate 102.

Precise control of the angular position of mirror 420 is effected through standard feedback techniques. The signal indicative of the actual angular position of mirror 420 from encoder 424 is fed back to comparator 506, which generates indicia of the difference between the actual position of mirror 420 and the desired position. The error signal is applied to DAC 508, and a resultant analog output signal amplified by amplifier 510 and applied as a drive signal to motor 424 of row deflection mechanism 408. If desired, comparator 506, DAC 508, and phase lock detector 512 can be components of a conventional servo loop controller chip.

Phase lock detector 512 generates an "X locked signal" during those periods that mirror 420 is in the desired position The X lock signal is applied to microprocessor 458 (through a suitable input port and bus 460) and employed to disable laser beam 400 when mirror 420 is displaced from the desired position by more than a predetermined amount.

Figure 6:
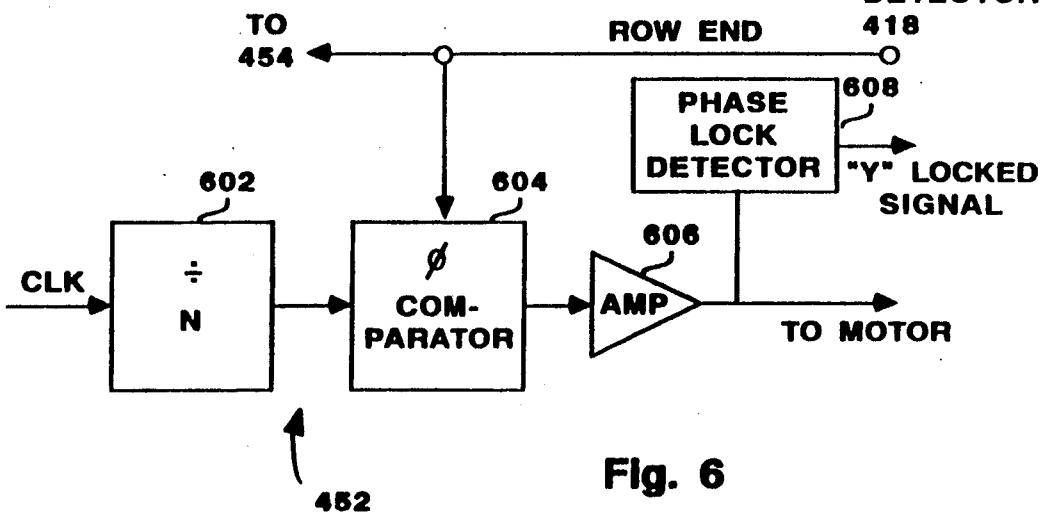
FIG. 6 is a block schematic of a preferred embodiment of the column servo control of FIG. 4.

Referring now to FIGS. 4 and 6, column servo control 452 provides appropriate drive signals to motor 416 of Y deflection mechanism 406 to rotate faceted mirror 412 at a rate corresponding to the desired Y scan rate, and in synchronism with the system clock signal (CLOCK) from scan sync circuit 454. Specifically, the clock signal from sync unit 454 is applied to a programmable divider 602 to develop a signal corresponding to the duration of a Y scan. Divider 602 is suitably loaded as part of the initialization routine by microprocessor 458 with a number corresponding to the number of pixels in the scan. The scan rate signal is applied to a conventional phase comparator 604, which is also receptive of the row end signal from detector 418 (indicative of a facet juncture traversing beam 400, and thus a return to the initial Y position). Phase comparator 604 generates an error signal indicative of phase error between the rotation of mirror 412, and the system clock, e.g., varies from a predetermined level (corresponding to, for example, 9600 rpm for a 24 facet mirror) by an amount corresponding to the phase error. The error signal is applied through amplifier 606 as a control signal to motor 416 of Y deflection mechanism 406.

A phase lock detector (e.g., noise level comparator) 608 is provided to detect instances where the rotation of faceted mirror 412 deviates from synchronism with the system clock by more than a predetermined amount. The Y-locked signal is provided to microprocessor 458 to disable laser 402 in out of sync conditions.

Figure 7:
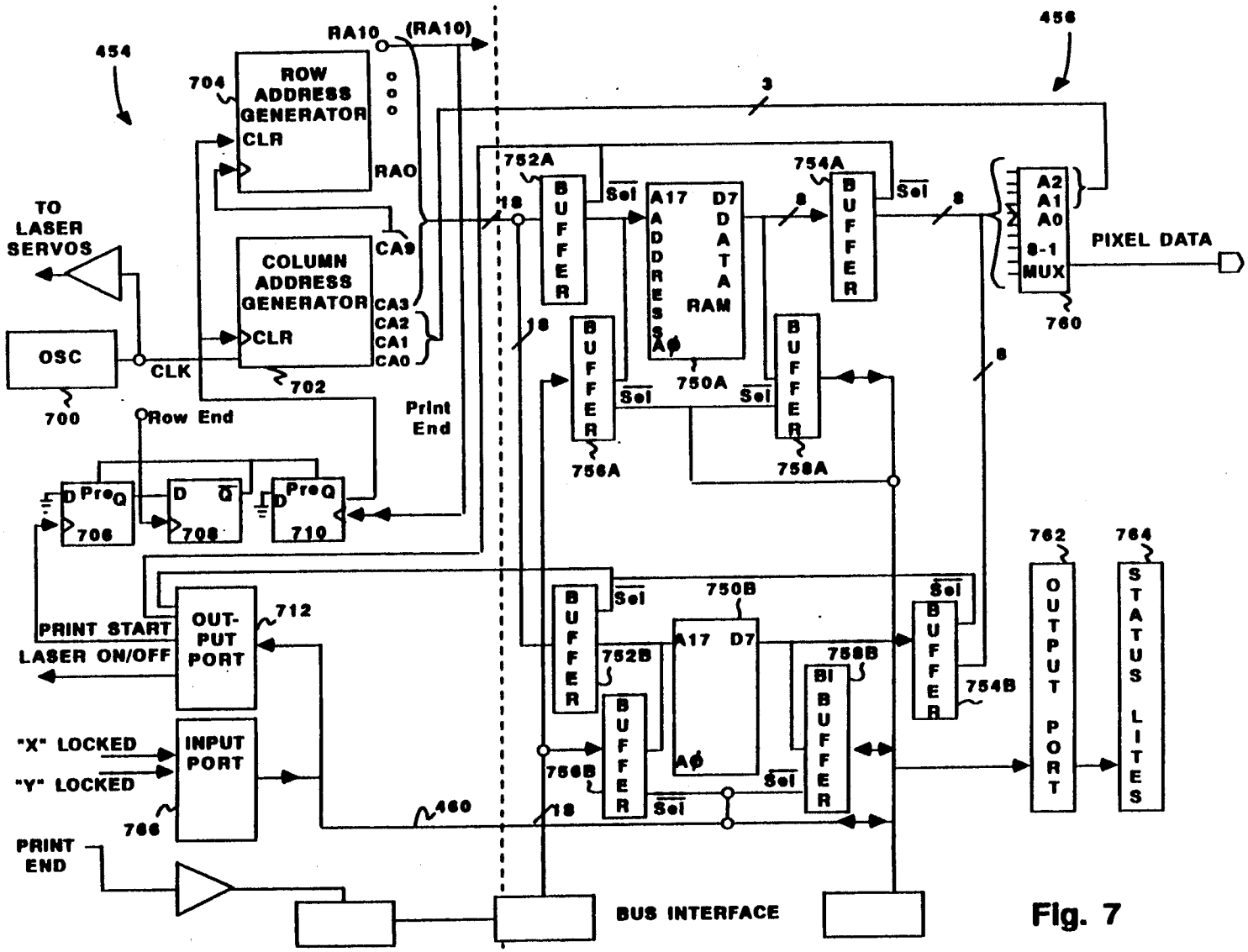
FIG. 7 is a block schematic of preferred embodiments of the beam scan sync unit and data buffer of FIG. 4.

Beam scan and sync control 454 provide the system clock signal and generates indicia of the relative address of the instantaneous pixel impinged upon by beam 400 for use by row servo control 450 and data buffer 456. Referring to FIGS. 4 and 7, scan control unit 454 includes an oscillator 700; respective counters 702 and 704, operating as column and row address generators, respectively; respective FF's 706, 708 and 710; and an output port 712 operating with bus 460.

Oscillator 700 generates a clock signal (CLOCK) at a predetermined frequency, e.g., 3.932160 MHz. As previously noted, the clock signal is applied to Y servo control 452 and, as will be explained, drives address generators 702 and 704.

Address generators 702 and 704, in effect, sequence through the addresses of the locations in data buffer 456 corresponding to the individual pixels in the order scanned. Clock signal (CLOCK) is applied to increment column address generator (counter) 704. An output corresponding to the total number of rows plus one (e.g., the tenth bit) is, in turn, taken from row address generator 704 as a print end control signal. The print end control signal is employed to generate clear signals to address generators 702 and 704.

Clear signals are provided by FF's 706, 708 and 710. When printing is to be initiated, a print start signal is generated by microprocessor 458 through output port 712. The print start signal is applied to the clock input of FF 706. The D input of FF 706 is tied low, and the clock signal therefore causes the Q output to assume a low logic level. The Q output of FF 706 is applied to the D input of FF 708. Upon the next successive positive going transition in row end from 700, the Q bar output of FF 708 will go high, presetting FF's 706 and 710 (causing the Q outputs thereof to assume a high level) The high logic level output signal from FF 710 in effect, removes a clear (inhibit) signal from address generators 702 and 704, permitting respective address counts to be developed. Generation of a print end signal by row address generator 704 clocks FF 710, the D input of which is tied low; causing the clear signal to be reapplied to address generators 702 and 704, clearing and inhibiting the address generators until generation of the next print-start signal.

Thus, at the beginning of the scan, address generators 702 and 704 initially contain counts indicative of column zero and row zero. After generation of the print start signal, and resultant removal of the clear signal, column address generator 702 is thereafter incremented in response to each CLOCK signal from oscillator 700. When a column address is reached corresponding to the total number of pixels in a row (e.g., 1024), column address generator 702 rolls over to resume a zero count, and row address generator 704 is concomitantly incremented. Counter 702 is thereafter incremented upon each CLOCK signal, until it rolls over, concomitantly incrementing row counter 704. This sequence continues until all rows have been scanned and counter 704 generates the print end signal.

Data buffer 456 provides data to laser beam control 403 on a pixel-by-pixel basis in synchronism with the scan. Referring to FIGS. 4 and 7, data buffer 456 suitably comprises respective random access memories (RAM) 750A and 750B, and associated sets of gating buffers, e.g., tri-state buffers 752A, 754A, 756B and 758B, respectively The data is presented in the order of the pixel-to-pixel scan.

As will be explained, the image data to be imprinted on successive substrates 102 are alternately loaded into RAMS 750A and 750B by microprocessor 458. While image data is being read out of one of RAMS 750A and 750B for printing on a substrate 102, image data for the next successive substrate 102 is loaded into the other of RAMS 750A and 750B. For ease of explanation, the respective corresponding elements will be referred to generally by their numeric designation.

RAMS 750A and 750B include at least one bit corresponding to each pixel in the print field matrix. As previously noted, the print field preferably comprises a 2048 by 1024 matrix. Accordingly, RAMS 750A and 750B suitably each comprise eight tandem 64K by 8 static RAMS.

RAMS 750 operate in alternative input and output modes, during which the pixel data is loaded into, and read out from, a selected RAM 750, respectively. The mode of operation of RAMS 750 are determined by the state of buffers 752, 754, 756 and 758. To load the image data into one of RAMS 750, the associated buffers 756 and 758 are actuated. The data is provided in 8 bit bytes, sequentially loaded into buffer 758 and loaded therefrom into consecutive bytes in the associated RAM 750 as indicated by an 18 bit address latched into buffer 756. The data is presented in the order of the pixel to pixel scan effected by beam 400.

If desired, an additional output port 762, and respective status lights or indicators 764, can be provided In addition, as previously noted, the X lock signal and Y lock signal from row servo control 450 and column servo control 452 are provided through a suitable input board 766 to bus 460 and ultimately to microcomputer 458.

When pixel data is to be read out of one of RAMS 750, the associated buffers 752 and 754 are selected (enabled). An 18 bit address is provided through buffer 752 to RAM 750, comprising a concatenation of bits 3 through 9 of column address generator 702 and bits 0 through 10 of row address generator 704 (the row address provides the most significant bits of the address). The 3 least significant bits of column address generator 702 are applied as the address to an addressable 8 to 1 demultiplexer 760, the inputs thereof being coupled to buffers 754A and 754B. Each byte of data in the selected RAM 750 provides 8 bits of pixel data. The respective bytes are identified by the 18 bit address applied to buffer 752. The particular bit corresponding to the addressed pixel is indicated by the 3 least significant bits of column address generator 702 applied as the address signal to demultiplexer 760. Thus, the pixel data is accessed in 8 bit bytes, and the individual bits output, in sequence using multiplexer 760. Such an approach is particularly advantageous in that it permits memory 750 to be accessed at a relatively low speed.

In operation, as previously noted, at the beginning of a print cycle, address generator 702 and 704 are cleared Accordingly, a zero address (corresponding to X=0) is applied to row servo control 450 (FIGS. 4, 5). Mirror 420 (FIG. 4) thus assumes an angular position corresponding to X=0, in accordance with the actual position of substrate 102 as indicated by the start address from temporal synchronizer 112 (FIGS. 1, 2). Since the print cycle is synchronized with the row end signal from Y deflection mechanism 406, mirror 412 (FIG. 4) is instantaneously at a position corresponding to Y=0. Further, assuming RAM 750A is loaded with pixel data and has been selected for output, zeros are initially loaded in buffer 752A and applied as the address to the demultiplexer 760. The contents of location 0 in RAM 750A (corresponding to pixels 0,0 through 0,7) are loaded into buffer 754. The 0,0,0 address applied to demultiplexer 760 causes bit 0 (corresponding to pixel 0,0) to be applied as the pixel data to beam laser control 403. Each clock pulse (CLOCK) corresponds to incremental movement of beam 400 by mirror 412, such that beam 400 is, at that point, entering the upon the next clock pulse, column address generator 702 is incremented, causing demultiplexer 60 to output the next bit (corresponding to pixel 0,1). As column address generator 702 is successively incremented, demultiplexer 760 outputs each bit of the byte in buffer 754A, until the three least significant bits of the column address roll over (go from 1,1,1 to 0,0,0) and the 4th least significant bit of the column address is incremented At that point, the next byte in RAM 750A is loaded into buffer 754 and the individual bits thereof are output by demultipexer 760 in response to successive clock pulses, and thus in synchronism with the Y scan traversal of beam 400. During this period X movement of substrate 102 is tracked, the start address applied to row servo 450 varying accordingly, causing mirror 420 to move so that the X position of the beam tracks substrate movement Ultimately, column address generator 702 reaches a count corresponding to the number of pixels in a row plus 1 (e.g., 1024). This occurs, as previously noted, in synchronizism with a facet of mirror 410 traversing beam 400 (beam 400 resumes its initial Y position). At this point column address generator 702 rolls over, resuming a 0 count, and row address generator 704 is incremented.

As previously noted, the row address is applied to the A input of adder 504 (FIG. 5) of X servo control 450. Thus, since mirror 420 is in a position corresponding to the previous row, the actual position signal from encoder 424 deviates from the desired position signal provided by adder 504. An error signal is therefore generated to adjust the position of mirror 420 so that a beam 408 is directed to a position corresponding to the new row. Concomitantly, the next successive data byte in RAM 750A (corresponding to pixels 1,0 through 1,7) is accessed, and the above described sequence continues for that row. The process is repeated for each successive row until all of the pixels in the print matrix have been output, whereupon the print end signal is generated by row address generator 704. The print end signal clears address generators 702 and 704, and is applied as an interrupt to microprocessor 458.

Figure 8:
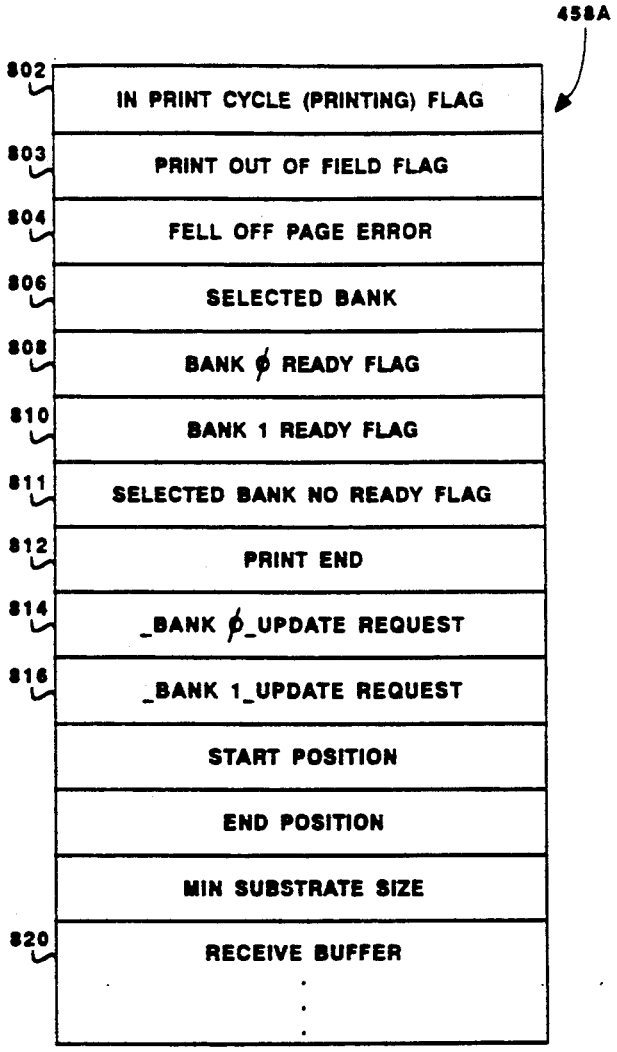
FIG. 8 is a schematic illustration of various variables and flags maintained in random access memory associated with the microprocessor of the positioning control of FIG. 4.

Processor 458, in effect, provides an interface between the overall printing system computer 118 and imprinting system 100. In general, microprocessor 458 operates in accordance with a program of instructions maintained in an internal memory, suitably a read only memory (ROM), and includes internal random access memory 458A for receiving image information from computer system 118 and maintaining various operating parameters, variables and flags. RAM 458A, and various flags and variables maintained therein, are schematically depicted in FIG. 8.

Figure 9:
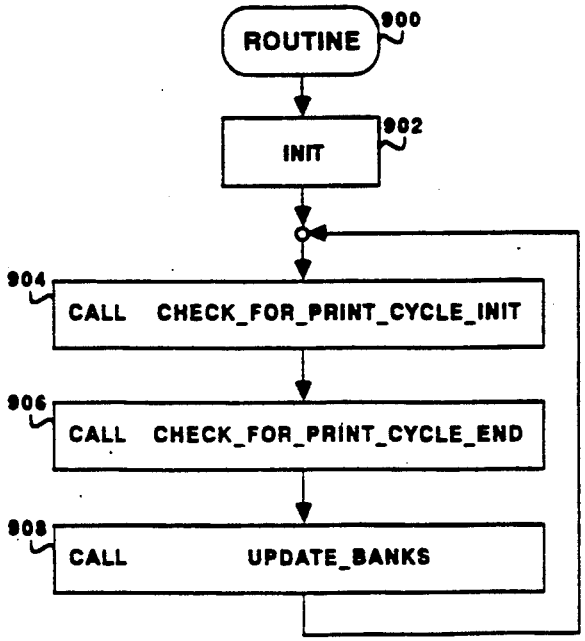
FIG. 9 is a schematic flow chart of the main print loop effected by the microprocessor of FIG. 4.

Referring now to FIG. 9, upon power-up, microprocessor 458 performs a standard processor initialization routine (step 902). Status checks and diagnostic routines are effected as well known in the art. After initialization is completed, a routine is executed to determine whether a print cycle is to be initiated, and whether various requisites for printing are met (routine 904). Briefly, synchronization (phase lock) of deflection mechanisms 406 and 408 is checked, and a determination made as to whether a substrate 102 is within the field of view of scanner 110. An initial bank of memory (RAM 750A or 750B) in data buffer 456 is selected, and a check made that data is installed in that memory. The start pulse is selectively generated and laser enabled as appropriate Routine 904 will be more fully described in conjunction with FIG. 10.

After a return from routine 904, a routine is executed to determine whether the print cycle has been completed, and, if so, to select the alternate bank of memory (750A or 750B) in data buffer 456 (routine 906). Routine 906 will be more fully explained in conjunction with FIG. 11.

Figure 12:
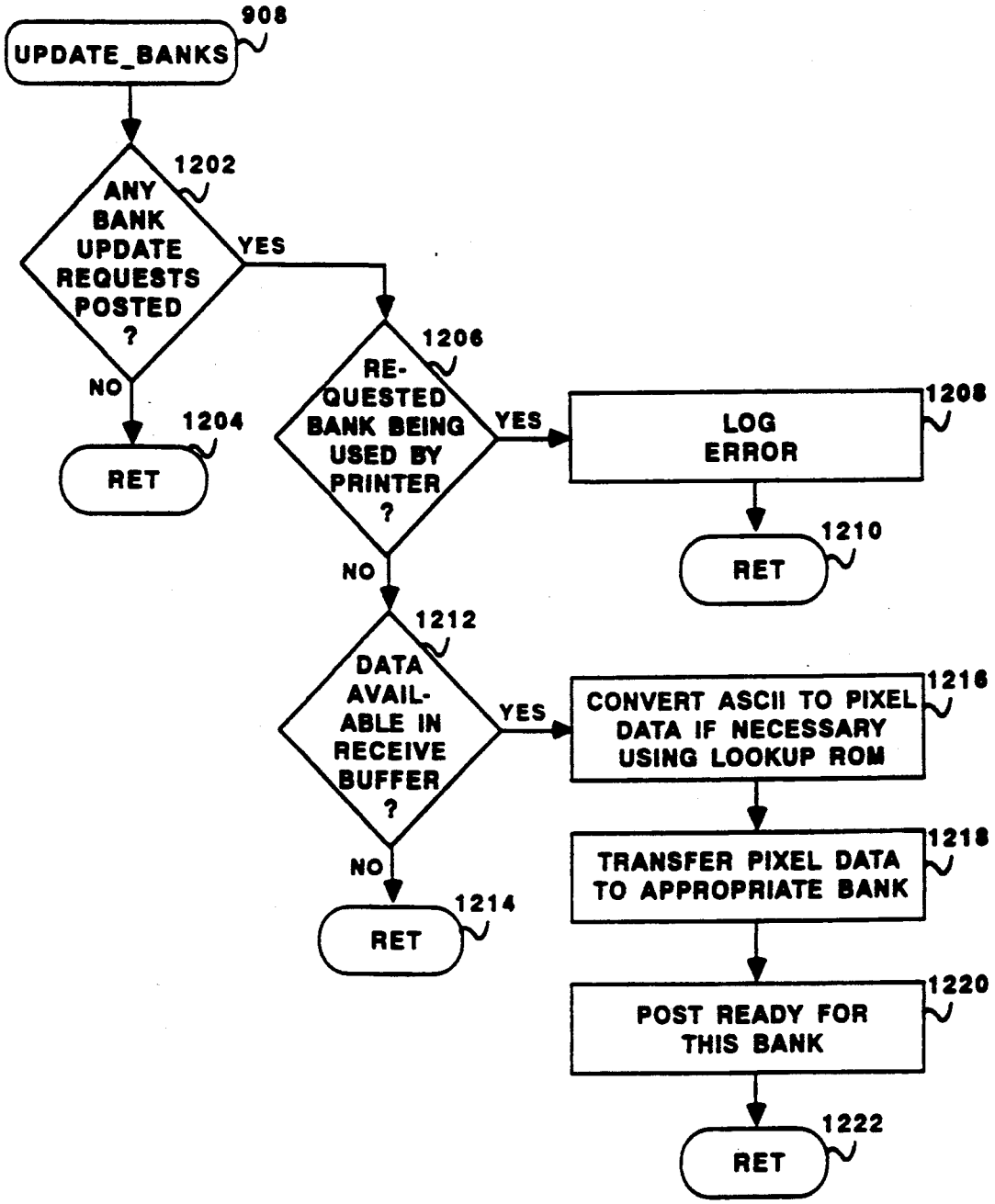
FIG. 12 is a schematic flow chart of the update data banks routine of FIG. 9.

Upon return from routine 906, a routine 908 is executed to update data buffer 456, as will be more fully described in conjunction with FIG. 12.

Routine 900 would also include standard housekeeping and communications handling routine (not shown).

Figure 10:
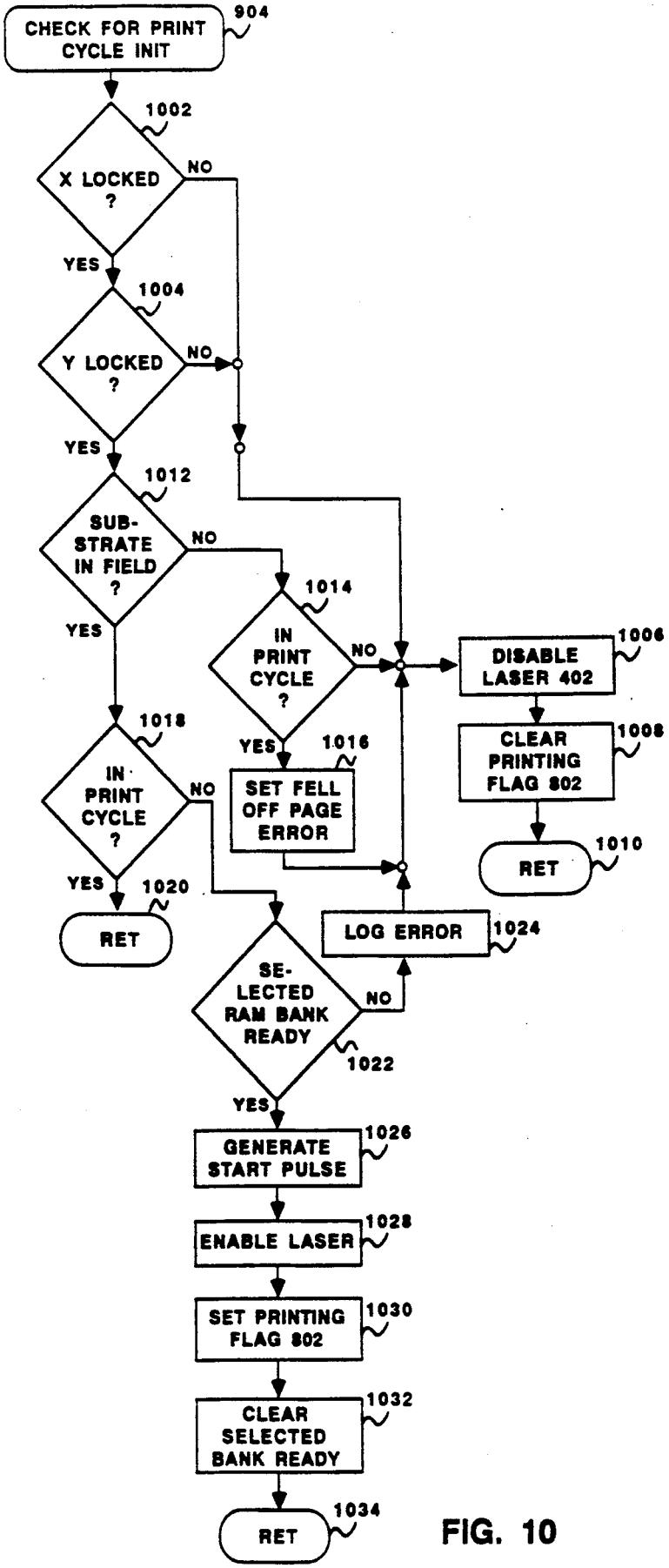
FIG. 10 is a schematic flow chart of the check for print cycle initiation routine of FIG. 9.

Referring now to FIGS. 8 and 10, check for print cycle initiation routine 904 will be described. Upon initiation of routine 904, various prerequisites for printing are checked. The X locked signal from column servo control 452 and Y locked signal from row servo control 450, as reflected in input port 766 (FIG. 7) are polled to ensure that the respective deflection mechanisms 406 and 408 are within limits of synchronization with the system clock and actual position of substrate 102 (steps 1002, 1004). If it is determined that either X lock or Y lock has been lost, laser 402 is immediately disabled (step 1006), and a printing flag 802 (FIG. 8) is cleared to indicate that the system is no longer in an active print cycle. A return to main routine 900 is then effected (step 1010).

Assuming that both deflection mechanisms 406 and 408 are locked on position, a determination is made as to whether or not a substrate is appropriately positioned within the field of view of scanner 110 for printing (step 1012). For example, successive transition data corresponding to leading and trailing edges of an object is read from microprocessor 234 in temporal synchronizer 112. If the position of either the leading or trailing edge of the object is equal to 0 (the object is not fully within the field of view of scanner 110) the object is deemed not to be an appropriately positioned substrate and a print out of full flag 803 set to facilitate generation of indicia to an operator. If desired, the size of the object (trailing edge position minus leading edge position) can be compared to minimum and maximum substrate sizes. If the size of the object is not within limits, it is deemed not to be a proper substrate. (The size test would be redundant if a similar discriminant was used in conjunction with routine 304 (FIG. 38) in temporal synchronizer 112.)

If the object fails to meet any of the discriminant criteria, in print cycle flag 802 is tested to determine whether or not the system is currently in a print cycle (step, 1014) and, if so, an error flag (fell off page error) 804 is set (step 1016). After error flag 804 has been set, as appropriate, laser 402 is disabled (step 1006), in print cycle flag 802 is cleared (step 1008), and a return is effected to main routine 900 (step 1010).

Assuming that it is determined that a properly positioned substrate is within the scanning field, in print cycle flag 802 is tested to determine whether the system is presently in a print cycle (step 1018), and, if so, a return to main routine 900 is effected (step 1020). If the system is not presently in a print cycle, a print cycle is selectively initiated.

The prerequisites for a print cycle are fast established. A determination is made as to whether image data has been properly installed in data buffer 456 (step 1022). Specifically, a selected bank variable 806 is tested to determine which of RAMS 750A and 750B is presently selected In the preferred embodiment, variable 806 is a single bit where a 0 value indicates RAM 750A and where a 1 value indicates RAM 750B. A test is made of a ready flag associated with the selected bank of memory (flag 808 or 810), to determine the status of the selected memory. (As will be explained, the bank ready flags are set by routine 908, after installation of image data in the memory bank has been completed.) If the selected bank is not ready, an error condition is logged (error flag 811 set) (step 1024). Laser 406 is then disabled, in print cycle flag 802 cleared and a return to main routine 900 effected (steps 1006, 1008, and 1010).

Assuming, however, that the selected RAM bank is ready, as reflected by the associated flag 808 or 810, a write cycle is initiated. A start pulse is generated to output port 710 to clock FF 706 (FIG. 7), and ultimately remove the clear signal from address generators 702 and 704 to begin clocking out data to laser power control 403 (Step 1026). An enable signal is applied to laser beam control 403 to enable laser 402 (step 1028). The in print cycle flag 802 is set (step 1030), and the bank ready flag (808 or 810) associated with the selected data bank (RAM 750A or 750B) is cleared to indicate it is being read out (step 1032). A return to main routine 900 is then effected (step 1034).

Figure 11:
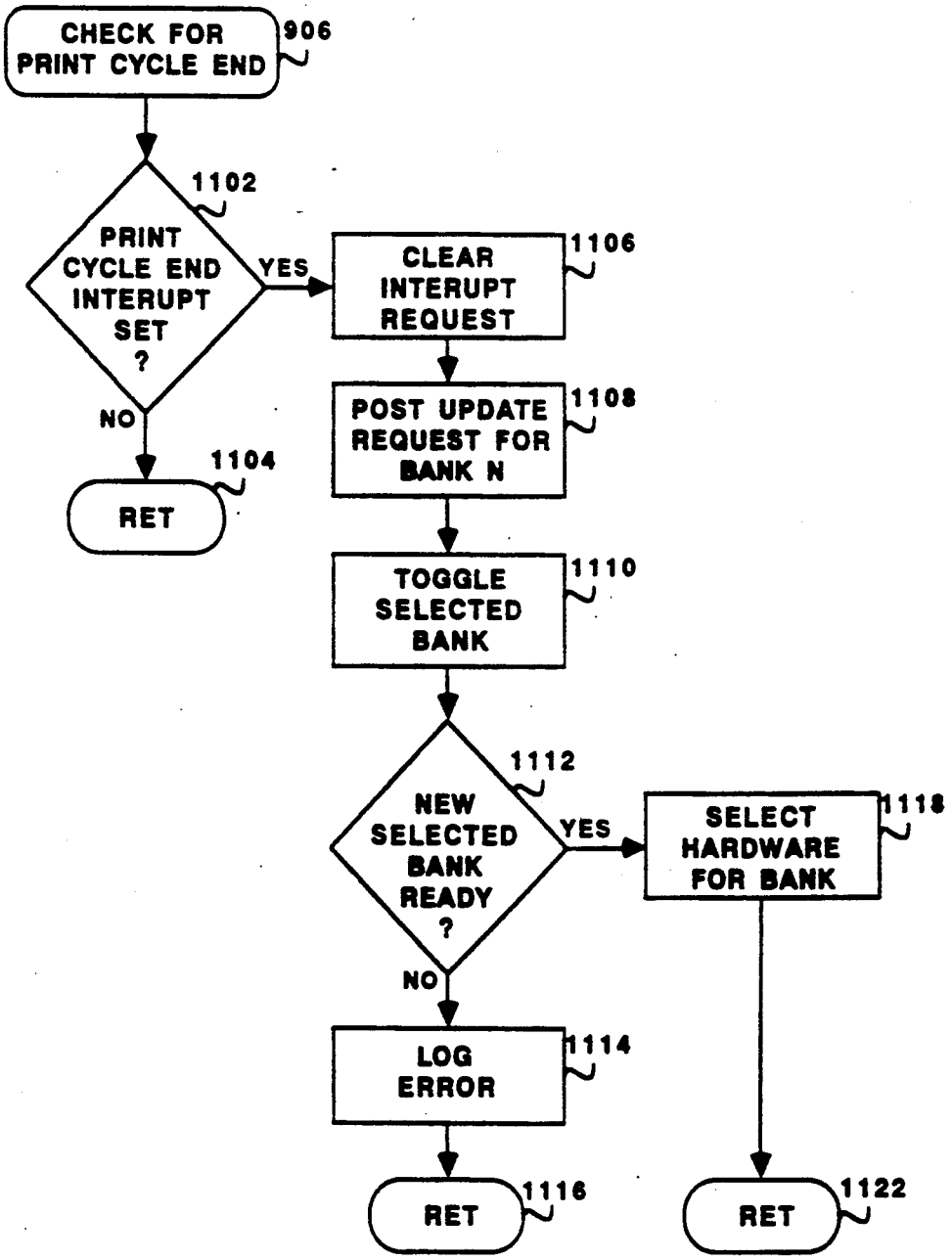
FIG. 11 is a schematic flow chart of the check for print cycle end routine of FIG. 9.

After a return is effected from routine 904 to main routine 900, check for print cycle end routine 906 is executed. Referring now to FIGS. 8 and 11, upon initiation of routine 906, a print end flag 812, set in response to the print end signal from row address generator 704 (applied as an interrupt to micro processor 458) is checked to determine whether all data has been clocked to print unit 114, i.e., the print cycle is completed (step 1102). If not, a return to main routine 900 is effected (step 1104) and the check for a print cycle initiation routine is re-executed.

Assuming, however, that the print end interrupt has occurred, and print end flag 812 set, flag 812 is cleared (step 1106), and an update request is posted for the selected bank of memory (RAM 750A or 750B), i.e., an associated update request flag (814 or 816) is set (step 1108). Selected bank variable 806 is then toggled to designate the alternative bank (step 1110). The status flag (808 or 810) of the selected RAM is then tested to determine if image data has been installed in the RAM (step 1112). If not, an error is logged (error flag set) (step 1114), and a return to main routine 900 effected (step 1116).

Assuming that the new selected bank contains image data, signals are generated to enable the associated buffers 752 and 754 (and disable buffers 756 and 758). The selected memory is thus postured for outputting data to print unit 114, and a return is effected to main routine 900 (step 1122).

Upon return from routine 906, update data buffer routine 908 is executed. Referring to FIG. 12, upon initiation of routine 908, update request flags 814 and 816 are tested to determine if either RAM 750A or 750B is ready to receive data (step 1202). If not, then a return to main routine 900 is effected (step 1204).

Assuming that an update request has been posted, a test is made to determine whether the bank is presently being used by the printer (the status of the associated buffers 752, 754, 756 and 758 are tested) (step 1206). If so, an error is logged (step 1008) and a return to main routine 900 is effected (step 1210).

If the requested bank is not being read out to the print unit 114, a determination is made as to whether there is data available for loading. Image data downloaded from computer system 118 (FIG. 1) is maintained in a receive buffer 820. Accordingly, a test of receive buffer 820 is made to determine if data is available in receive buffer 820 for loading into data buffer 456. (step 1212). If no data is available in receive buffer 820, i.e., no data packet has been received by microprocessor 458, a return to main routine 900 is effected (step 1214).

Assuming that data is available in receive buffer 820, a data transfer process is initiated. Any necessary conversion of the data is effected, e.g., converting ASCII data into pixel format using a look up table in ROM (step 1216). The pixel data is then transferred to the appropriate data bank (RAM 750A or 750B) (step 1218). The associated ready flag (808 or 810) is then set (step 1220), and a return to main routine 900 effected (step 1222).

Figure 13:
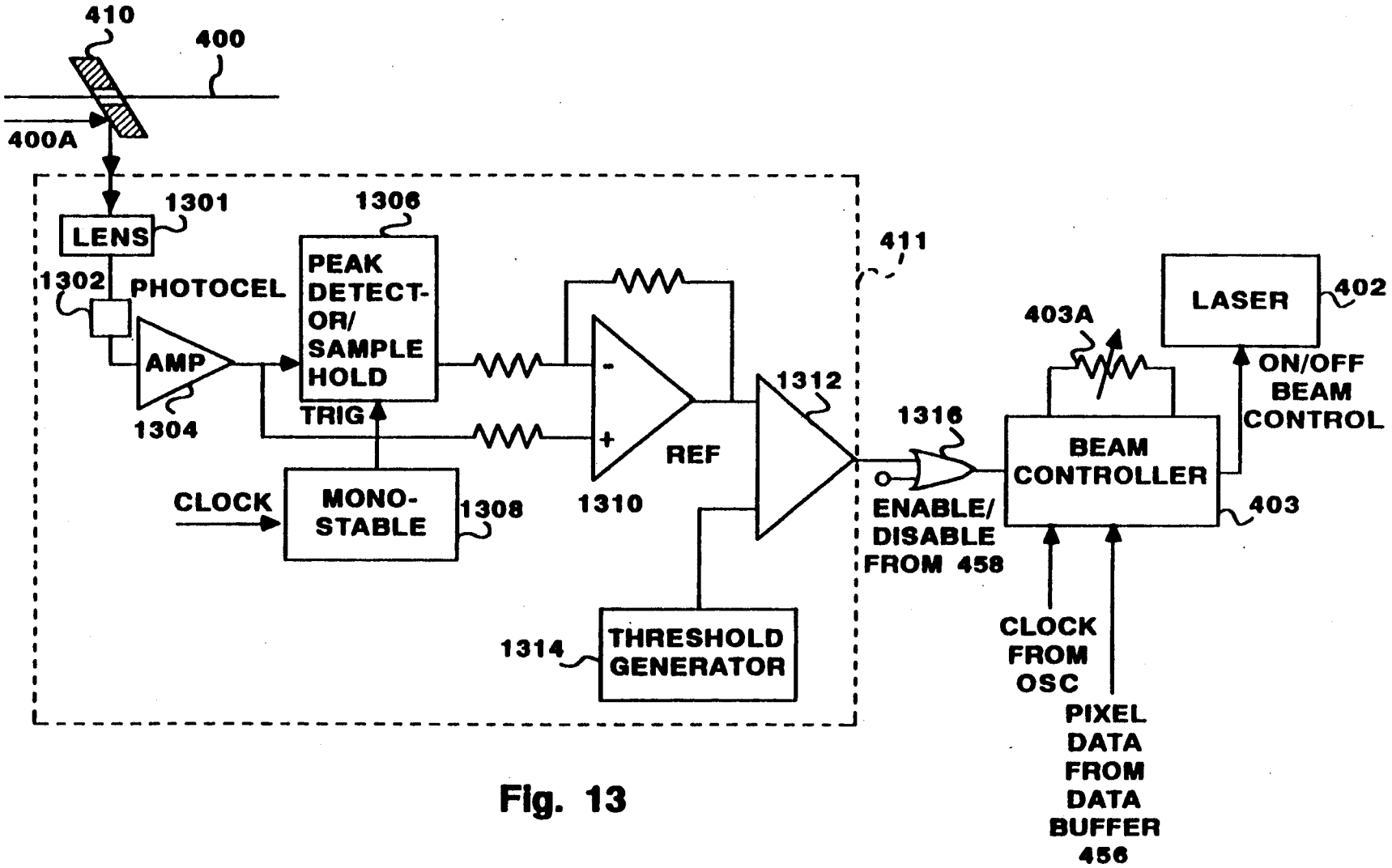
FIG. 13 is a block schematic of a preferred embodiment of the burn control of FIG. 4.

As previously noted, the extent to which laser beam 400 burns a given pixel is controlled by beam control circuit 411. Referring now to FIG. 13, burn control circuit 411 suitably comprises a photocell 1302, an amplifier 1304, a conventional sample and hold circuit 1306, a monostable multivibrator 1308, a differential amplifier 1310, a comparator 1312, and a suitable threshold generator 1314.

The reflections from substrate 102 are routed by apertured mirror 410 through a suitable focusing lens system 1301 to a photocell 1302. The voltage of the signal generated by photocell 1302 will be proportional to the amount of light reflected from substrate 102 at the particular pixel.

Changes in the level of reflection are monitored to determine the extent of burn. When laser beam 400 initially impinges upon the pixel, a certain amount of light will be reflected back along the path from substrate 102. As the pixel darkens, more light will be absorbed at the pixel, and the reflection decreases. When the change between the initial level of reflection and the current level of reflection reaches a threshold value, a certain amount of density change has been effected at the substrate, at which point beam 400 is to be effectively disabled. Accordingly, the level of reflection signal is passed through an amplifier 1304 to sample and hold circuit 1306. Sample and hold circuit 1306 captures indicia of the initial level of reflection from the pixel. Sample and hold circuit 1306 is suitably triggered by a monostable multivibrator 1308, which is in turn triggered by the clock signal CLOCK from oscillator 700 in beam sync control 454. Sample and hold circuit 1306 detects and holds the peak brightness level value during the period of monostable 1308. The output of sample and hold circuit 1306 and the output of amplifier 1304 (indicative of the current level of reflection) are applied to differential amplifier 1310 to develop a difference signal representative of the difference in reflection over time. The difference signal signal is applied to one input of comparator 1312, for comparison against a threshhold level.

The threshold level, representing a maximum desired level of darkening, is generated by threshold generator 1314. Threshhold generator 1314 may be, for example, a voltage divider to develop a constant reference signal, may include a potentiometer to provide for manual adjustment, or may comprise a latch and digital to analogue converter cooperating with microprocessor 458 to provide for more sophisticated modes of threshold adjustment.

The maximum intensity is set by a potentiometer 403A associated with beam control 103. The output of comparator 1312 is applied to beam controller 403 to effectively disable laser 402, e.g., turn off or decrease the intensity of beam 400, or otherwise remove laser beam 400 from the pixel. The disable signal from comparator 1312 is suitably applied to beam controller 403 through an OR gate 1316 to facilitate disabling laser beam 400 by either burn control circuit 411 or microprocessor 458. If desired, the change in reflection can be, in effect, integrated over several pixels by adjusting the width of the pulse generated by monostable 1308 to provide for more generalized beam control.

Figure 14:
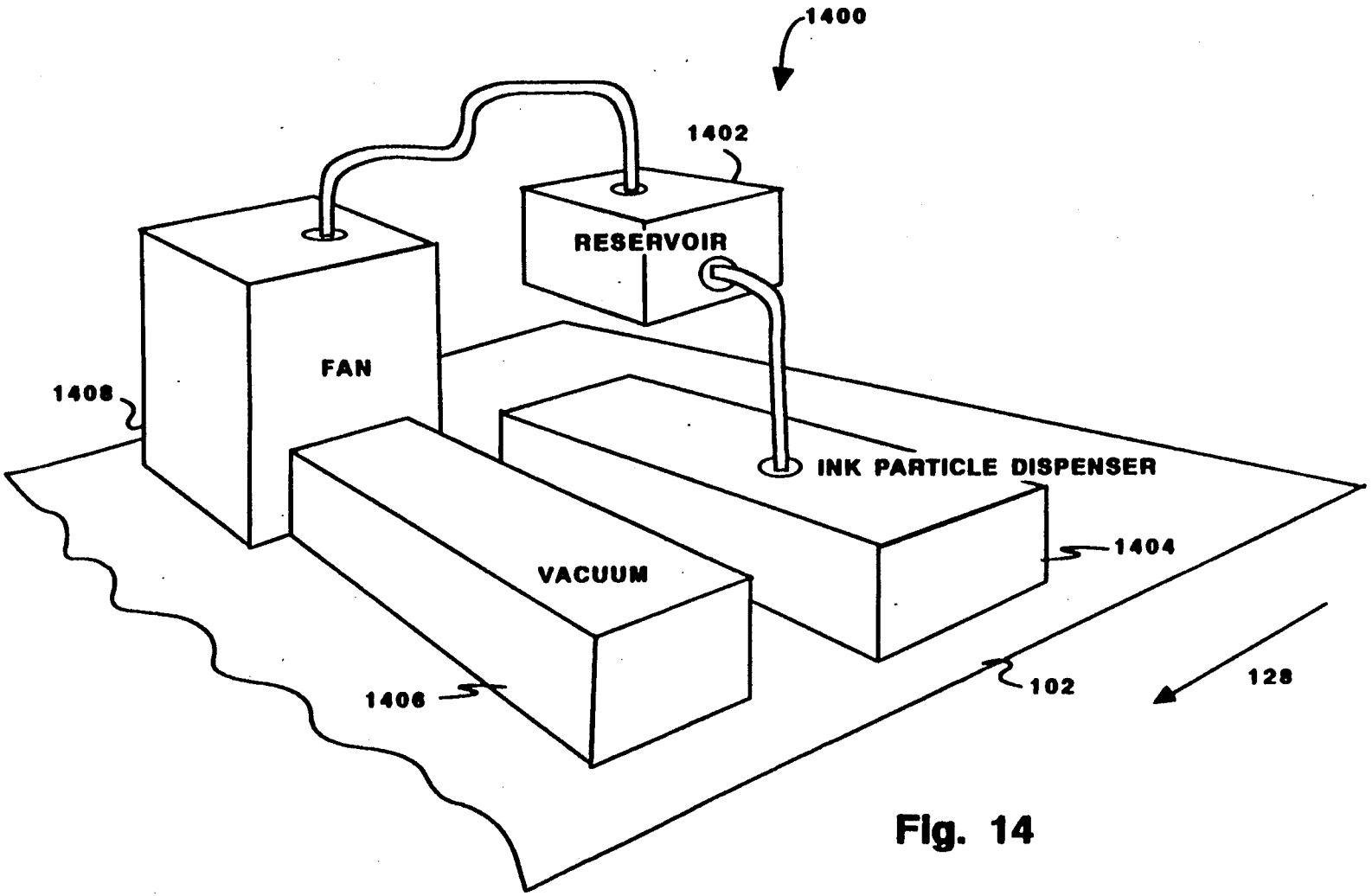
FIG. 14 is a schematic illustration of an ink dispenser for use in conjunction with the printer of FIG. 4.

In some instances, the nature of substrate 102 may be such that burning of the pixel by laser beam 400 does not produce an adequate print. In such case, laser beam 400 may employed to activate ink particles or the like disbursed over the print field. Referring to FIG. 14, an example of such an ink dispersal system 1400 suitable for use with the print surface of substrate 102 disposed horizontally will be described. System 1400 suitably includes a reservoir 1402 containing particulate heat sensitive ink powder similar to that used in plain paper copiers, i.e., comprising pigmented plastic particles. Ferite elements in the particles, typically included in plain paper copiers, may be included, but would not be necessary for the system of FIG. 14. Ink particles are dispensed from reservoir 1402 to an ink particle dispenser 1404.

Dispenser 1404 is disposed overlying substrate 102 upstream of the print field to deposit a relatively uniform thin layer of ink particles on substrate 102 over an area having an extent in the Y direction at least equal to the Y extent of the print field. As substrate 102 is transported past dispenser 1404, the print field is covered with a relatively uniform thin layer of particles.

Laser beam 400, when activated to irradiate a pixel, melts the ink particles in that pixel, causing adherence of the ink to substrate 102. After the substrate passes the print field, it is subjected to a vacuum provided by a vacuum head 1406 cooperating with a blower 1408 which removes the unmelted ink particles from substrate 102 and returns them to reservoir 1402. Thus, laser beam 400 selectively darkens the pixels with ink particles. Other ink dispersal mechanisms can, of course, be employed.

Other beam actuated inking and darkening mechanisms are also contemplated. For example, thermosensitive paper, or treated paper that darkens when irradiated by a laser or electron beam may be utilized.

It will be appreciated that the present invention provides a particularly advantageous imprinting system. System 100 permits imprinting on dissimilar sized books and can, if desired, operate upon several substrates simultaneously.

It will be understood that while various of the conductors and connections are shown in the drawing as single lines, they are not so shown in a limiting sense, and may comprise plural conductors or connections as understood in the art. Similarly, power connections, various control lines and the like, to the various elements are omitted from the drawing for the sake of clarity Further, the above description is of preferred exemplary embodiments of the present invention, and the invention is not limited to the specific forms shown. For example, while the preferred embodiment employs a laser printer, line scanner 110 and temporal synchronizer 112 can in some instances be advantageously employed with a conventional ink jet print head or an applique mechanism, such as, for example, a labeler. Likewise, while in the preferred embodiment, the laser beam effects a raster type scan, other modes of scanning can be employed For example, by employing a different Y deflection mechanism (e.g., a pivoted flat mirror) the beam can be made to scan in reverse directions in alternate rows. The arrangement of data in RAMS 750 would be varied accordingly. These and other modifications may be made in the design and arrangement of the elements within the scope of the invention, as expressed in the intended claims.

I claim:

1. An imprinting system of the type including: a conveyor; a plurality of feeders for delivering signatures to said conveyor, said conveyor moving said signatures in a predetermined direction along a conveyor path; a printer disposed proximate to said conveyor along said path for imprinting on portions of signatures within a predetermined print field; improved wherein said system further comprises:

scanner means for scanning a field of view disposed along said path extending in said predetermined direction in predetermined relation to said print field and generating scanner output signals indicative of the position of said signatures within said field of view; and means for varying the position of said print field relative to said field of view in accordance with movement of said signatures through said field of view.

2. The system of claim 1 wherein said scanner means comprises a line scanner, disposed to scan a line of successive nominal pixels extending in said predetermined direction along said path, said scanner output signal comprising a video signal indicative of the brightness level at each of said pixels in succession.

3. The system of claim 1 wherein said printer comprises:

a beam generator;

means for controllably deflecting said beam to irradiate selected portions of said signature; and means for causing ink to adhere to said irradiated portions of said signature.

4. The system of claim 1 wherein said printer is a dot matrix printer disposed to selectively print a plurality of dots along a line transverse to said predetermined direction, said printer printing dots along respective transverse lines as the conveyor moves the signature through the print field in response to a line clock signal applied thereto to form a matrix of dots; and said means for controlling comprises means for generating said line clock signals in response to incremental travel of said signature within said field of view.

5. The system of claim 1 wherein the extent of said print field along said predetermined direction is contained within said path portion.

6. An imprinting system of the type including: a conveyor; a plurality of feeders for delivering signatures to said conveyor, said conveyor moving said signatures in a predetermined direction along a conveyor path; a printer disposed proximate to said conveyor along said path for imprinting on portions of signatures within a predetermined print field; improved wherein:

said print field is nominally divided into a matrix of pixels and said printer effects imprinting on successive lines of pixels disposed transverse to said predetermined direction, and said system further comprises:

scanner means for scanning a field of view disposed along said path extending in said predetermined direction in predetermined relation to said print field and generating scanner output signals indicative of the position of said signatures within said field of view; and means for varying the position of successive lines of pixels relative to said field of view in accordance with changes in position of said signatures within said field of view.

7. An imprinting system of the type including: a conveyor; a plurality of feeders for delivering signatures to said conveyor, said conveyor moving said signatures in a predetermined direction along a conveyor path; a printer disposed proximate to said conveyor along said path for imprinting on portions of signatures within a predetermined print field; improved wherein said system further comprises:

scanner means for scanning a field of view disposed along said path extending in said predetermined direction in predetermined relation to said print field and generating scanner output signals indicative of the position of said signatures within said field of view; and means, responsive to said scanner output signals, for controlling said printer in accordance with the position of said signatures within said field of view; and means, responsive to said scanner output signals, for controlling said printer in accordance with the position of said signatures within said field of view; and said printer comprises:

a beam generator;

Y deflection means for controllably deflecting said beam to effect a scan of said beam along a direction transverse to said predetermined direction; and X deflection means, responsive to signature position signals indicative of the position of said signature within said field of view and desired relative position signals indicative of a desired relative position within said print field, for controllably deflecting said beam along said predetermined direction.

8. The system of claim 7 wherein said beam is a laser beam.

9. The system of claim 8 further including means for generating a clock signal having a predetermined frequency, and wherein said Y deflection means comprises:

a multifaceted mirror disposed for rotation in the path of said beam, such that each of said facets traverses the path of said beam in succession, the angle between said beam and the mirror surface varying from an initial angle to a terminal angle to deflect said beam from an initial to a terminal position as each facet of said mirror progresses through traversal of the path of the beam; and means for rotating said mirror in synchronism with said clock signal such that the traversal of the beam by each mirror facet corresponds to a predetermined number of clock pulses.

10. The system of claim 9 wherein said means for rotating said multifaceted mirror comprises;

a motor, responsive to drive signals thereto, for effecting rotation of said multifaceted mirror;

means for generating a facet traversal signal indicative of the completion of a traversal of said facets through said beam; and a phase comparator, receptive of said facet traversal signal and a signal indicative of said predetermined number of clock pulses, for generating an error signal for application as a drive signal to said motor.

11. The system of claim 10 wherein said means for generating said facet traversal signal comprises means for detecting junctures between said facets.

12. The system of claim 9 wherein said X deflection means comprises:

a mirror having a generally planar surface disposed in the path of said beam and mounted for pivoting about an axis disposed along said traverse direction; and means for varying the angular disposition of said planar surface in accordance with the position of said signature within said field of view and desired relative position within said print field.

13. The system of claim 12 wherein said means for varying the angular disposition of said planar surface comprises:

a second motor, responsive to control signals applied thereto, coupled to said planar surface to effect changes in the angular disposition of said planar surface;

means for generating a signal indicative of the angular position of said mirror;

means for generating a signal indicative of the algebraic sum of the position of said signature within said field of view and said desired relative position; and means for generating an error signal indicative of the deviation of the angular position of said planar surface from a position indicated by said sum, said error signal being applied as a control signal to said motor.

14. The system of claim 8 wherein said X deflection means comprises:

a mirror having a generally planar surface disposed in the path of said beam and mounted for pivoting about an axis disposed along said traverse direction; and means for varying the angular disposition of said planar surface in accordance with the position of said signature within said field of view and said desired relative position within said print field.

15. The system of claim 14 wherein said means for varying the angular disposition of said planar surface comprises:

a motor, responsive to control signals applied thereto, coupled to said planar surface to effect changes in the angular disposition of said planar surface;

means for generating a signal indicative of the angular position of said mirror;

means for generating a signal indicative of the algebraic sum of the position of said signature within said field of view and said desired relative position; and means for generating an error signal indicative of the deviation of the angular position of said planar surface from a position indicated by said sum, said error signal being applied as a control signal to said motor.

16. The system of claim 7 further comprising:

means for adjusting said signals indicative of a desired relative position in synchronism with transverse scan of said beam.

17. The system of claim 7 wherein said print field is nominally divided into a matrix of pixels and said system further comprises:

a first counter for generating a count indicative of a column address, said first counter being incremented in synchronism with said transverse scan of said beam, and being reset to an initial count upon attaining a predetermined count indicative of the number of pixels in a row of said matrix;

a second counter for generating a count indicative of a row address, said second counter being incremented in response to said first counter attaining said predetermined count, indicia of said row address count being applied to said X deflection means as said desired relative position signals;

storage means, responsive to said address counts, for storing indicia of the brightness value of, each of said pixels and selectively outputing, indicia of said pixel values to said printer.

18. The system of claim 17 wherein said storage means comprises:

a random access memory (RAM);

an output buffer; and a demultiplexer; to selectively receive a byte of pixel value data, read from a location in said RAM in accordance with a predetermined number of the most significant bits of a concatenation of said row and column addresses;

said demultiplexer being coupled to said output buffer and generating to said printer indicia of the value of a selected bit of said pixel data byte in accordance with the least significant bits of said concatenation.

19. The system of claim 7 wherein said scanner field of view is nominally divided into a plurality of pixels, and said scanner output signal represents the state of each pixel in succession, and said means for controlling said printer comprises:

means for generating a pixel count indicative of the relative position within said field of view of a pixel contemporaneously represented in said scanner output signal;

means for detecting transitions in said scanner output signal;

means for storing the pixel count associated with, and indicia of the polarity of, said transitions;

means for selectively communicating said pixel counts to said X deflection means as said signature position signals.

20. The system of claim 7 wherein said printer further comprises means for causing ink to selectively adhere to portions of said signature irradiated by said beam.

21. An imprinting system of the type including: a conveyor; a plurality of feeders for delivering signatures to said conveyor, said conveyor moving said signatures in a predetermined direction along a conveyor path; a printer disposed proximate to said conveyor along said path for imprinting on portions of signatures within a predetermined print field; improved wherein said field of view is nominally divided into a plurality of pixels, and said system further comprises:

scanner means for scanning a field of view disposed along said path extending in said predetermined direction in predetermined relation to said print field and generating scanner output signals indicative of the position of said signatures within said field of view; and means, responsive to said scanner output signals, for controlling said printer in accordance with the position of said signature within said field of view, said means for controlling said printer comprising:

means for generating a pixel count indicative of the relative address within said field of view of a pixel contemporaneously represented in said scanner output signal;

means for detecting transitions in said scanner output signal; and means for storing the pixel count associated with an indicia of the polarity of said transitions as indicia of the position of said signature within the field of view.

22. A method of imprinting on a signature moving along a conveyor path in a predetermined direction, said method comprising the steps of:

periodically generating signature position signals indicative of the contemporaneous position of said signature as it moves along said conveyor path within a predetermined portion of said path;

imprinting on successive lines on said signature, said lines being disposed transverse to said predetermined direction; and varying the position of said successive lines of imprinting relative said path portion in accordance with changes in position of said signature within said path portion.

23. The method of claim 22 wherein said generating signature position signals step comprises the steps of:

generating a video signal indicative of the brightness level at successive nominal pixels disposed along a line along said predetermined direction, said video signal representing the brightness level each of said pixels in succession, advancing from pixel to pixel in accordance with a clock signal;

generating a pixel count indicative of the pixel contemporaneously represented in said video signal;

detecting transitions in brightness level in said video signal, and storing indicia of the pixel count associated with said transition; and selectively adjusting the position of said successive lines of imprinting relative to said path portion in accordance with said transition pixel count.

24. The method of claim 22 wherein said imprinting step comprises the step of selectively directing a laser beam to impinge on said signature.

25. The method of claim 22 wherein each of said successive lines of imprinting are nominally divided into lines cf adjacent pixels, said successive lines of imprinting together forming a nominal matrix of pixels, and:

said imprinting step comprises the steps of:

controllably scanning a beam along a direction transverse to said predetermined direction; and controllably deflecting said beam along said predetermined direction; and said varying the position step comprises varying the amount of deflection in said predetermined direction in accordance with changes in position of said signature within said path portion.

26. A method of printing on a signature moving along a conveyor path in a collator system of the type comprising a conveyor, a plurality of feeders for delivering signatures to said conveyor for movement in a predetermined direction along a conveyor path, a printer disposed proximate to said conveyor along said path for imprinting on portions of said signatures within a predetermined print field, said method comprising the steps of:

periodically generating signature position signals indicative of the position of said signature as it moves through a predetermined portion of said conveyor path; and varying the position of said print field relative to said path portion in accordance with movement of said signature through said path portion.

27. A system for printing information on a substrate, a system of the type including a printer having a predetermined print field and means for conveying said substrate along a predetermined direction into operative relation within said printer print field, improved wherein:

said print field is nominally divided into a matrix of pixels and said printer effects imprinting on successive lines of pixels disposed transverse to said predetermined direction;

said system further comprises:

scanner means for scanning a field of view disposed along said path extending in said predetermined direction in predetermined relation to said print field and generating scanner output signals indicative of the position of said substrates within said field of view; and means for varying the position of successive lines of pixels relative to said field of view in accordance with changes in position of said substrate within said field of view; and said printer comprises:

a laser beam generator, responsive to control signals applied thereto, for controllably generating a laser beam;

means for controllably directing said laser beam to a desired position on said substrate to effect a controlled burn of said substrate at said position;

means for generating a reflection level signal indication of the level of reflections, of said beam from said substrate; and means, responsive to said reflection level signal, for generating control signals to said beam generator to cause said beam to cease effecting said controlled burn.

28. A method for printing on a substrate moving along a path in a predetermined direction, comprising the steps of:

periodically generating indicia of the contemporaneous position of said substrate as it moves along said conveyor path with a predetermined portion of said path;

controllably generating a laser beam;

controllably directing said laser beam along successive lines on said substrate, said lines being disposed transverse to said predetermined direction;

varying the position of said successive lines relative said path portion in accordance with changes in position of said substrate within said path portion; and as to respective desired positions along said lines:

selectively effecting a controlled burn to darken said substrate at said positions;

generating a signal indicative of the level reflections from said desired position; and responsive to a predetermined change in said reflection level signals causing said laser beam to cease effecting said controlled burn at said position.

29. A system for imprinting on signatures in accordance with image data, said system being of the type including: a conveyor having a predetermined direction of movement; a plurality of feeders for delivering signatures said conveyor, a printer disposed proximate said conveyor for imprinting on portions of a signature within a predetermined print field; improved wherein said printer comprises:

laser beam generator means for controllably generating a laser beam in accordance with control signals applied thereto;

means for controllably deflecting said beam to traverse a line on said signature; and means for generating, in synchronism with traversal of said line, control signals in accordance with said image data said means for controllably deflecting comprising:

Y deflection means for controllably deflecting said beam to effect a traversal of said beam along a direction transverse to said predetermined direction; and X deflection means, responsive to signature position signals indicative of the position of said signature relative to the position said beam generator means and desired relative position signals indicative of a desired position of a transverse line relative previous transverse lines, for controllably deflecting said beam along said predetermined direction.

30. The system of claim 29 wherein said printer further comprises:

means for generating a signal indicative of reflections of said beam from a unit area on said signature subjected to said beam;

means for generating a signal indicative of the change in the level of said reflections from said unit area;

means for comparing said change to a threshold level; and means for effectively disabling said beam relative to said unit area response to said comparison.

31. The system of claim 29 wherein said transverse line nominally comprises a plurality of pixels disposed along a nominal X direction and said means for generating control signals comprises:

a first counter for generating a count indicative of an X position address, said first counter being incremented in synchronism with said transverse scan of said beam, and being reset to an initial count upon attaining a predetermined count indicative of the number of pixels in said line;

a second counter for generating a count indicative of an X position address, said second counter being incremented in response to said first counter attaining said predetermined count, indicia of said X position address count being applied to said X deflection means as said desired relative position signals;

storage means, responsive to said address counts, for storing indicia of the brightness value of, each of said pixels and selectively outputting, indicia of said pixel values to said laser beam generating means.

32. The system of claim 31 wherein said storage means comprises:

a random access memory (RAM);

an output buffer; and a demultiplexer;

said output buffer cooperating with said RAM, to selectively receive a byte of pixel value data, read significant bits of a concatenation of said row and column addresses;

said demultiplexer being coupled to said output buffer and generating to said printer indicia of the value of a selected bit of said pixel data byte in accordance with the least significant bits of said concatenation.

33. The system of claim 29 further including means for generating a clock signal having a predetermined frequency, and wherein said Y deflection means comprises:

a multifaceted mirror disposed for rotation in the path of said beam, such that each of said facets traverses the path of said beam in succession, the angle between said beam and the mirror surface varying from an initial angle to a terminal angle to deflect said beam from an initial to a terminal position as each facet of said mirror progresses through traversal of the path of the beam; and means for rotating said mirror in synchronism with said clock signal such that the traversal of the beam by each mirror facet corresponds to a predetermined number of clock pulses.

34. The system of claim 33 wherein said means for rotating said multifaceted mirror comprises;

a motor, responsive to drive signals thereto, for effecting rotation of said multifaceted mirror;

means for generating a facet traversal signal indicative of the completion of a traversal of individual ones of said facets through said beam; and a phase comparator, receptive of said facet traversal signal and a signal indicative of said predetermined number of clock pulses, for generating an error signal for application as a drive signal to said motor.

35. The system of claim 34 wherein said means for generating said facet traversal signal comprises means for detecting junctures between said facets.

36. The system of claim 33 wherein said X deflection means comprises:

a mirror having a generally planar surface disposed in the path of said beam and mounted for pivoting about an axis disposed along said traverse direction; and;

means for varying the angular disposition of said planar surface in accordance with the position of said signature within desired relative position within said print field.

37. The system of claim 36 wherein said means for varying the angular disposition of said planar surface comprises:

a second motor, responsive to control signals applied thereto, coupled to said planar surface to effect changes in the angular disposition of said planar surface;

means for generating a signal indicative of the angular position of said mirror;

means for generating a signal indicative of the algebraic sum of the position of said signature within said field of view and said desired relative position; and means for generating an error signal indicative of the deviation of the angular position of said planar surface from a position indicated by said sum, said error signal being applied as a control signal to said motor.

38. The system of claim 29 wherein said X deflection means comprises:

a mirror having a surface disposed in the path of said beam and mounted for pivoting about an axis disposed along said traverse direction; and;

means for varying the angular disposition of said surface in accordance with the position of said signature within desired relative position within said print field.

39. The system of claim 38 wherein said means for varying the angular disposition of said surface comprises:

a second motor, responsive to control signals applied thereto, coupled to said surface to effect changes in the angular disposition of said surface;

means for generating a signal indicative of the angular position of said mirror;

means for generating a signal indicative of the algebraic sum of the position of said signature within said field of view and said desired relative position; and means for generating an error signal indicative of the deviation of the angular position of said surface from a position indicated by said sum, said error signal being applied as a control signal to said motor.

40. The system of claim 29 wherein said transverse line nominally comprises a plurality of pixels and said means for generating control signals comprises:

a first counter for generating a count indicative of a column address, said first counter being incremented in synchronism with said transverse traversal of said beam, and being reset to an initial count upon attaining a predetermined count indicative of the number of pixels in said line;

storage means, responsive to said address counts, for storing indicia of the brightness value of each of said pixels and selectively outputting, indicia of said pixel values to said laser beam generating means.

41. The system of claim 40 further including means for generating a clock signal having a predetermined frequency, and wherein said Y deflection means comprises:

multifaceted mirror disposed for rotation in the path of said beam, such that each of said facets traverses the path of said beam in succession, the angle between said beam and the mirror surface varying from an initial angle to a terminal angle to deflect said beam from an initial to a terminal position as each facet of said mirror progresses through traversal of the path of the beam; and means for rotating said mirror in synchronism with said clock signal such that the traversal of the beam by each mirror facet corresponds to a predetermined number of clock pulses.

42. The system of claim 41 wherein said means for rotating said multifaceted mirror comprises;

a motor, responsive to drive signals thereto, for effecting rotation of said multifaceted mirror;

means for generating a facet traversal signal indicative of the completion of a traversal of individual ones of said facets through said beam; and a phase comparator, receptive of said facet traversal signal and a signal indicative of said predetermined number of clock pulses, for generating an error signal for application as a drive signal to said motor.

43. The system of claim 42 wherein said means for generating said facet traversal signal comprises means for detecting junctures between said facets.

* * * * *